US011328739B2

(12) United States Patent
Gao

(10) Patent No.: US 11,328,739 B2
(45) **Date of Patent: *May 10, 2022**

(54) UNVOICED VOICED DECISION FOR SPEECH PROCESSING CROSS REFERENCE TO RELATED APPLICATIONS

(71) Applicant: HUAWEI TECHNOLOGIES CO., LTD., Guangdong (CN)

(72) Inventor: Yang Gao, Mission Viejo, CA (US)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 259 days.

This patent is subject to a terminal disclaimer.

(21) Appl. No.: 16/506,357

(22) Filed: Jul. 9, 2019

(65) Prior Publication Data

US 2020/0005812 A1 Jan. 2, 2020

Related U.S. Application Data

(63) Continuation of application No. 16/040,225, filed on Jul. 19, 2018, now Pat. No. 10,347,275, which is a (Continued)

(51) Int. Cl.

| | |
|---|---|
| ***G10L 25/78*** | (2013.01) |
| ***G10L 25/93*** | (2013.01) |
| ***G10L 19/22*** | (2013.01) |

(52) U.S. Cl.

CPC ..... *G10L 25/78* (2013.01); *G10L 19/22* (2013.01); *G10L 25/93* (2013.01)

(58) Field of Classification Search

None

See application file for complete search history.

(56) References Cited

U.S. PATENT DOCUMENTS 5,216,747 A 6/1993 Hardwick et al.
5,586,180 A * 12/1996 Degenhardt ..... G10L 25/78 379/388.04

(Continued)

FOREIGN PATENT DOCUMENTS

CN 1470052 A 1/2004
CN 1703736 A 11/2005

(Continued)

OTHER PUBLICATIONS

Puder H, Soffke O. An approach to an optimized voice-activity detector for noisy speech signals. In 2002 11th European Signal Processing Conference Sep. 3, 2002 (pp. 1-4). IEEE. (Year: 2002).*

(Continued)

*Primary Examiner* — Jonathan C Kim

(57) ABSTRACT

Method and apparatus for speech processing are disclosed. A first unvoicing parameter for a first frame of a speech signal is determined, and furthered smoothed based on a second unvoicing parameter for a second frame prior to the first frame. A difference between the first unvoicing parameter and the smoothed unvoicing parameter for the first subframe is computed and a unvoiced/voiced classification of the first frame is determined using the computed difference as a decision parameter. Further processing, such as Bandwidth extension (BWE) is performed on based on the classification of the first frame.

18 Claims, 16 Drawing Sheets

Related U.S. Application Data continuation of application No. 15/391,247, filed on Dec. 27, 2016, now Pat. No. 10,043,539, which is a continuation of application No. 14/476,547, filed on Sep. 3, 2014, now Pat. No. 9,570,093.

(60) Provisional application No. 61/875,198, filed on Sep. 9, 2013.

(56) References Cited

U.S. PATENT DOCUMENTS

| | | | | |
|---|---|---|---|---|
| 5,960,388 | A | 9/1999 | Nishiguchi et al. | |
| 5,991,725 | A | 11/1999 | Asghar et al. | |
| 6,415,029 | B1 * | 7/2002 | Piket | H04B 3/234 379/406.01 |
| 6,427,134 | B1 | 7/2002 | Garner et al. | |
| 6,453,285 | B1 * | 9/2002 | Anderson | G10L 25/78 381/94.3 |
| 6,556,967 | B1 * | 4/2003 | Nelson | G10L 25/78 704/208 |
| 6,615,169 | B1 | 9/2003 | Ojala et al. | |
| 6,640,208 | B1 | 10/2003 | Zhang et al. | |
| 6,795,559 | B1 * | 9/2004 | Taura | H04B 1/1027 381/94.4 |
| 7,606,703 | B2 | 10/2009 | Unno | |
| 8,849,433 | B2 * | 9/2014 | Seefeldt | H04H 40/18 700/94 |
| 9,570,093 | B2 | 2/2017 | Gao | |
| 2001/0049598 | A1 | 12/2001 | Das | |
| 2002/0165711 | A1 * | 11/2002 | Boland | G10L 25/78 704/231 |
| 2003/0055646 | A1 * | 3/2003 | Yoshioka | G10L 25/93 704/258 |
| 2004/0138874 | A1 | 7/2004 | Kaajas et al. | |
| 2004/0172255 | A1 * | 9/2004 | Aoki | H04M 3/564 704/275 |
| 2005/0049855 | A1 * | 3/2005 | Chong-White | G10L 19/173 704/219 |
| 2005/0177363 | A1 * | 8/2005 | Oh | G10L 25/93 704/208 |
| 2005/0177364 | A1 * | 8/2005 | Jelinek | G10L 19/20 704/214 |
| 2005/0267746 | A1 | 12/2005 | Jelinek et al. | |
| 2007/0027681 | A1 * | 2/2007 | Kim | G10L 25/93 704/208 |
| 2007/0121456 | A1 * | 5/2007 | Kono | G11B 20/1833 369/53.15 |
| 2008/0027716 | A1 * | 1/2008 | Rajendran | G10L 19/012 704/210 |
| 2008/0151408 | A1 | 6/2008 | Kang et al. | |
| 2008/0240282 | A1 * | 10/2008 | Lin | H04L 25/022 375/285 |
| 2009/0299739 | A1 * | 12/2009 | Chan | H04R 3/005 704/225 |
| 2011/0022924 | A1 | 1/2011 | Malenovsky et al. | |
| 2011/0035213 | A1 * | 2/2011 | Malenovsky | G10L 25/78 704/208 |
| 2011/0123121 | A1 * | 5/2011 | Springer | H04N 19/176 382/199 |
| 2011/0125505 | A1 | 5/2011 | Vaillancourt et al. | |
| 2011/0173004 | A1 | 7/2011 | Bessette et al. | |
| 2011/0264447 | A1 * | 10/2011 | Visser | G10L 25/78 704/208 |
| 2011/0313778 | A1 | 12/2011 | Son et al. | |
| 2012/0053929 | A1 * | 3/2012 | Hsia | G16H 50/30 704/9 |
| 2013/0151255 | A1 | 6/2013 | Kim et al. | |
| 2013/0262122 | A1 | 10/2013 | Kim et al. | |
| 2013/0282846 | A1 | 10/2013 | Wang et al. | |
| 2014/0074481 | A1 * | 3/2014 | Newman | G10L 25/51 704/275 |
| 2015/0039304 | A1 * | 2/2015 | Wein | G10L 25/78 704/233 |
| 2015/0073783 | A1 * | 3/2015 | Gao | G10L 25/93 704/214 |

FOREIGN PATENT DOCUMENTS

| | | | |
|---|---|---|---|
| CN | 1703737 | A | 11/2005 |
| CN | 1909060 | A | 2/2007 |
| CN | 101379551 | A | 3/2009 |
| JP | H08335100 | A | 12/1996 |
| JP | 2000515987 | A | 11/2000 |
| JP | 2002530705 | A | 9/2002 |
| JP | 2006502427 | A | 1/2006 |
| JP | 2009522588 | A | 6/2009 |
| JP | 2010530078 | A | 9/2010 |
| RU | 2419891 | C2 | 5/2011 |
| WO | 2007073604 | A1 | 7/2007 |
| WO | 2008151408 | A1 | 12/2008 |
| WO | 2009000073 | A1 | 12/2008 |
| WO | 2012116587 | A1 | 9/2012 |

OTHER PUBLICATIONS

Puder, Henning, and Oliver Soffke. "An approach to an optimized voice-activity detector for noisy speech signals." Signal Processing Conference, 2002 11th European. IEEE, 2002, 4 pages.

Brueckmann, Robert, Andrea Scheidig, and Horst-Michael Gross. , "Adaptive noise reduction and voice activity detection for improved verbal human-robot interaction using binaural data." Robotics and Automation, 2007 IEEE International Conference on. IEEE, 2007. Roma, Italy, Apr. 10-14, 2007, 6 pages.

* cited by examiner

UNVOICED VOICED DECISION FOR SPEECH PROCESSING CROSS REFERENCE TO RELATED APPLICATIONS

CROSS-REFERENCE TO RELATED APPLICATIONS

This application is a continuation of U.S. patent application Ser. No. 16/040,225, filed on Jul. 19, 2018, which is a continuation of U.S. patent application Ser. No. 15/391,247, filed on Dec. 27, 2016, now U.S. Pat. No. 10,043,539, which is a continuation of U.S. patent application Ser. No. 14/476,547, filed on Sep. 3, 2014, now U.S. Pat. No. 9,570,093, which claims benefit of U.S. Provisional Application No. 61/875,198, filed on Sep. 9, 2013. All of the afore-mentioned patent applications are hereby incorporated by reference in their entireties.

TECHNICAL FIELD

The present invention is generally in the field of speech processing, and in particular to Voiced/Unvoiced Decision for speech processing.

BACKGROUND

Speech coding refers to a process that reduces the bit rate of a speech file. Speech coding is an application of data compression of digital audio signals containing speech. Speech coding uses speech-specific parameter estimation using audio signal processing techniques to model the speech signal, combined with generic data compression algorithms to represent the resulting modeled parameters in a compact bitstream. The objective of speech coding is to achieve savings in the required memory storage space, transmission bandwidth and transmission power by reducing the number of bits per sample such that the decoded (decompressed) speech is perceptually indistinguishable from the original speech.

However, speech coders are lossy coders, i.e., the decoded signal is different from the original. Therefore, one of the goals in speech coding is to minimize the distortion (or perceptible loss) at a given bit rate, or minimize the bit rate to reach a given distortion.

Speech coding differs from other forms of audio coding in that speech is a much simpler signal than most other audio signals, and a lot more statistical information is available about the properties of speech. As a result, some auditory information which is relevant in audio coding can be unnecessary in the speech coding context. In speech coding, the most important criterion is preservation of intelligibility and "pleasantness" of speech, with a constrained amount of transmitted data.

The intelligibility of speech includes, besides the actual literal content, also speaker identity, emotions, intonation, timbre etc. that are all important for perfect intelligibility. The more abstract concept of pleasantness of degraded speech is a different property than intelligibility, since it is possible that degraded speech is completely intelligible, but subjectively annoying to the listener.

The redundancy of speech wave forms may be considered with respect to several different types of speech signal, such as voiced and unvoiced speech signals. Voiced sounds, e.g., 'a', 'b', are essentially due to vibrations of the vocal cords, and are oscillatory. Therefore, over short periods of time, they are well modeled by sums of periodic signals such as sinusoids. In other words, for voiced speech, the speech signal is essentially periodic. However, this periodicity may be variable over the duration of a speech segment and the shape of the periodic wave usually changes gradually from segment to segment. A low bit rate speech coding could greatly benefit from exploring such periodicity. The voiced speech period is also called pitch, and pitch prediction is often named Long-Term Prediction (LTP). In contrast, unvoiced sounds such as 's', 'sh', are more noise-like. This is because unvoiced speech signal is more like a random noise and has a smaller amount of predictability.

Traditionally, all parametric speech coding methods make use of the redundancy inherent in the speech signal to reduce the amount of information that must be sent and to estimate the parameters of speech samples of a signal at short intervals. This redundancy primarily arises from the repetition of speech wave shapes at a quasi-periodic rate, and the slow changing spectral envelop of speech signal.

The redundancy of speech wave forms may be considered with respect to several different types of speech signal, such as voiced and unvoiced. Although the speech signal is essentially periodic for voiced speech, this periodicity may be variable over the duration of a speech segment and the shape of the periodic wave usually changes gradually from segment to segment. A low bit rate speech coding could greatly benefit from exploring such periodicity. The voiced speech period is also called pitch, and pitch prediction is often named Long-Term Prediction (LTP). As for unvoiced speech, the signal is more like a random noise and has a smaller amount of predictability.

In either case, parametric coding may be used to reduce the redundancy of the speech segments by separating the excitation component of speech signal from the spectral envelop component. The slowly changing spectral envelope can be represented by Linear Prediction Coding (LPC) also called Short-Term Prediction (STP). A low bit rate speech coding could also benefit a lot from exploring such a Short-Term Prediction. The coding advantage arises from the slow rate at which the parameters change. Yet, it is rare for the parameters to be significantly different from the values held within a few milliseconds. Accordingly, at the sampling rate of 8 kHz, 12.8 kHz or 16 kHz, the speech coding algorithm is such that the nominal frame duration is in the range of ten to thirty milliseconds. A frame duration of twenty milliseconds is the most common choice.

In more recent well-known standards such as G.723.1, G.729, G.718, Enhanced Full Rate (EFR), Selectable Mode Vocoder (SMV), Adaptive Multi-Rate (AMR), Variable-Rate Multimode Wideband (VMR-WB), or Adaptive Multi-Rate Wideband (AMR-WB), Code Excited Linear Prediction Technique ("CELP") has been adopted. CELP is commonly understood as a technical combination of Coded Excitation, Long-Term Prediction and Short-Term Prediction. CELP is mainly used to encode speech signal by benefiting from specific human voice characteristics or human vocal voice production model. CELP Speech Coding is a very popular algorithm principle in speech compression area although the details of CELP for different codecs could be significantly different. Owing to its popularity, CELP algorithm has been used in various ITU-T, MPEG, 3GPP, and 3GPP2 standards. Variants of CELP include algebraic CELP, relaxed CELP, low-delay CELP and vector sum excited linear prediction, and others. CELP is a generic term for a class of algorithms and not for a particular codec.

The CELP algorithm is based on four main ideas. First, a source-filter model of speech production through linear prediction (LP) is used. The source-filter model of speech production models speech as a combination of a sound source, such as the vocal cords, and a linear acoustic filter, the vocal tract (and radiation characteristic). In implementation of the source-filter model of speech production, the sound source, or excitation signal, is often modelled as a periodic impulse train, for voiced speech, or white noise for unvoiced speech. Second, an adaptive and a fixed codebook is used as the input (excitation) of the LP model. Third, a search is performed in closed-loop in a "perceptually weighted domain." Fourth, vector quantization (VQ) is applied.

SUMMARY

In accordance with an embodiment of the present invention, a method for speech processing comprises determining an unvoicing/voicing parameter reflecting a characteristic of unvoiced/voicing speech in a current frame of a speech signal comprising a plurality of frames. A smoothed unvoicing/voicing parameter is determined to include information of the unvoicing/voicing parameter in a frame prior to the current frame of the speech signal. A difference between the unvoicing/voicing parameter and the smoothed unvoicing/voicing parameter is computed. The method further includes generating an unvoiced/voiced decision point for determining whether the current frame comprises unvoiced speech or voiced speech using the computed difference as a decision parameter.

In an alternative embodiment, a speech processing apparatus comprises a processor, and a computer readable storage medium storing programming for execution by the processor. The programming include instructions to determine an unvoicing/voicing parameter reflecting a characteristic of unvoiced/voicing speech in a current frame of a speech signal comprising a plurality of frames, and determine a smoothed unvoicing/voicing parameter to include information of the unvoicing/voicing parameter in a frame prior to the current frame of the speech signal. The programming further include instructions to compute a difference between the unvoicing/voicing parameter and the smoothed unvoicing/voicing parameter, and generate a unvoiced/voiced decision point for determining whether the current frame comprises unvoiced speech or voiced speech using the computed difference as a decision parameter.

In an alternative embodiment, a method for speech processing comprises providing a plurality of frames of a speech signal and determining, for a current frame, a first parameter for a first frequency band from a first energy envelope of the speech signal in the time domain and a second parameter for a second frequency band from a second energy envelope of the speech signal in the time domain. A smoothed first parameter and a smoothed second parameter are determined from the previous frames of the speech signal. The first parameter is compared with the smoothed first parameter and the second parameter is compared with the smoothed second parameter. An unvoiced/voiced decision point is generated for determining whether the current frame comprises unvoiced speech or voiced speech using the comparison as a decision parameter.

BRIEF DESCRIPTION OF THE DRAWINGS

For a more complete understanding of the present invention, and the advantages thereof, reference is now made to the following descriptions taken in conjunction with the accompanying drawings, in which:

FIGS. 12A and 12B illustrate examples of frequency domain encoding/decoding with bandwidth extension, wherein FIG. 12A illustrates the encoder with BWE side information while FIG. 12B illustrates the decoder with BWE;

DETAILED DESCRIPTION OF ILLUSTRATIVE EMBODIMENTS

In modern audio/speech digital signal communication system, a digital signal is compressed at an encoder, and the compressed information or bit-stream can be packetized and sent to a decoder frame by frame through a communication channel. The decoder receives and decodes the compressed information to obtain the audio/speech digital signal.

In order to encode speech signal more efficiently, speech signal may be classified into different classes and each class is encoded in a different way. For example, in some standards such as G.718, VMR-WB, or AMR-WB, speech signal is classified into UNVOICED, TRANSITION, GENERIC, VOICED, and NOISE.

Voiced speech signal is a quasi-periodic type of signal, which usually has more energy in low frequency area than in high frequency area. In contrast, unvoiced speech signal is a noise-like signal, which usually has more energy in high frequency area than in low frequency area. Unvoiced/Voiced classification or Unvoiced Decision is widely used in the field of speech signal coding, speech signal bandwidth extension (BWE), speech signal enhancement and speech signal background noise reduction (NR).

In speech coding, unvoiced speech signal and voiced speech signal may be encoded/decoded in a different way. In speech signal bandwidth extension, the extended high band signal energy of unvoiced speech signal may be controlled differently from that of voiced speech signal. In speech signal background noise reduction, NR algorithm may be different for unvoiced speech signal and voiced speech signal. So, a robust Unvoiced Decision is important for the above kinds of applications.

Embodiments of the present invention improve the accuracy of classifying an audio signal as a voiced signal or an unvoiced signal prior to speech coding, bandwidth extension, and/or speech enhancement operations. Therefore, embodiments of the present invention may be applied to speech signal coding, speech signal bandwidth extension, speech signal enhancement and speech signal background noise reduction. In particular, embodiments of the present invention may be used to improve the standard of ITU-T AMR-WB speech coder in bandwidth extension.

Figure 1:
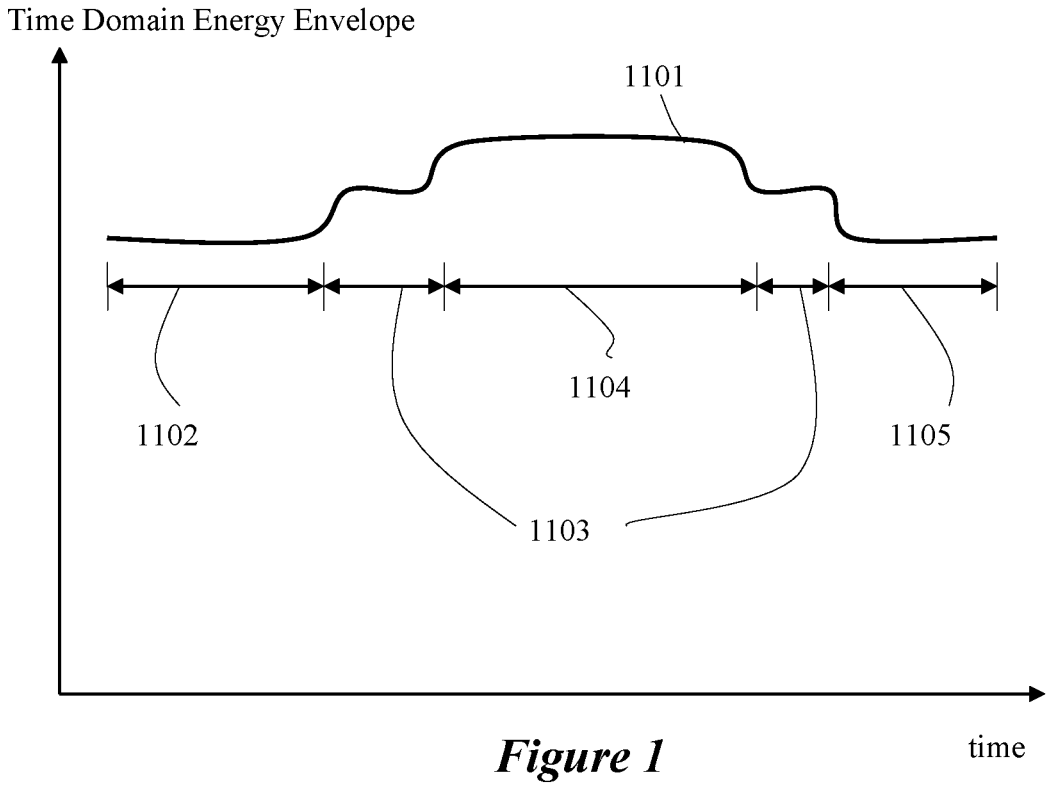
FIG. 1 illustrates a time domain energy evaluation of a low frequency band speech signal in accordance with embodiments of the present invention.
Figure 2:
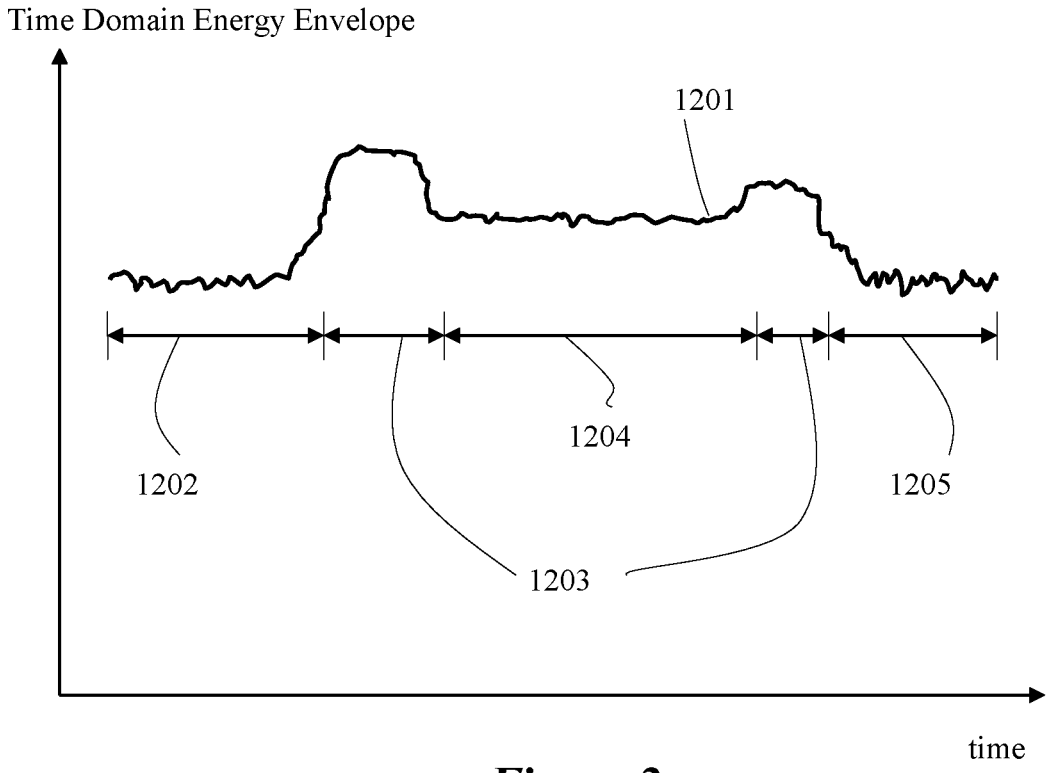
FIG. 2 illustrates a time domain energy evaluation of high frequency band speech signal in accordance with embodiments of the present invention.

An illustration of the characteristics of the speech signal used to improve the accuracy of the classification of audio signal into voiced signal or unvoiced signal in accordance with embodiments of the present invention will be illustrated using FIGS. 1 and 2. The speech signal is evaluated in two regimes: a low frequency band and a high frequency band in the illustrations below.

FIG. 1 illustrates a time domain energy evaluation of a low frequency band speech signal in accordance with embodiments of the present invention.

The time domain energy envelope 1101 of the low frequency band speech is a smoothed energy envelope over time and includes a first background noise region 1102 and a second background noise region 1105 separated by unvoiced speech regions 1103 and voiced speech region 1104. The low frequency voiced speech signal of the voiced speech region 1104 has a higher energy than the low frequency unvoiced speech signal in the unvoiced speech regions 1103. Additionally, low frequency unvoiced speech signal has higher or closer energy compared to low frequency background noise signal.

FIG. 2 illustrates a time domain energy evaluation of high frequency band speech signal in accordance with embodiments of the present invention.

In contrast to FIG. 1, high frequency speech signal has different characteristics. The time domain energy envelope of the high band speech signal 1201, which is the smoothed energy envelope over time, includes a first background noise region 1202 and a second background noise region 1205 separated by unvoiced speech regions 1203 and a voiced speech region 1204. The high frequency voiced speech signal has lower energy than high frequency unvoiced speech signal. The high frequency unvoiced speech signal has much higher energy compared to high frequency background noise signal. However, the high frequency unvoiced speech signal 1203 has a relatively shorter duration than the voiced speech 1204.

Embodiments of the present invention leverage this difference in characteristics between the voiced and unvoiced speech in different frequency bands in the time domain. For example, a signal in the present frame may be identified to be a voiced signal by determining that the energy of the signal is higher than the corresponding unvoiced signal at low band but not in high band. Similarly, a signal in the present frame may be identified to be an unvoiced signal by identifying that the energy of the signal is lower than the corresponding voiced signal at low band but higher than the corresponding voiced signal in high band.

Traditionally, two major parameters are used to detect Unvoiced/Voiced speech signal. One parameter represents signal periodicity and another parameter indicates spectral tilt, which is the degree to which intensity drops off as frequency increases.

A popular signal periodicity parameter is provided below in Equation (1).

$$P^1_{voicing} = \frac{\sum_n s_w(n)\cdot s_w(n-\text{Pitch})}{\sqrt{\left(\sum_n |s_w(n)|^2\right)\left(\sum_n |s_w(n-\text{Pitch})|^2\right)}} = \frac{\langle s_w(n), s_w(n-\text{Pitch})\rangle}{\sqrt{\|s_w(n)\|^2\|s_w(n-\text{Pitch})\|^2}} \tag{1}$$

In Equation (1), $s_w(n)$ is a weighted speech signal, the numerator is a correlation, and the denominator is an energy normalization factor. The periodicity parameter is also called "pitch correlation" or "voicing". Another example voicing parameter is provided below in Equation (2).

$$P^2_{voicing} = \frac{\sum_n |G_p\cdot e_p(n)|^2 - \sum_n |G_c\cdot e_c(n)|^2}{\sum_n |G_p\cdot e_p(n)|^2 + \sum_n |G_c\cdot e_c(n)|^2} = \frac{\|G_p\cdot e_p(n)\|^2 - \|G_c\cdot e_c(n)\|^2}{\|G_p\cdot e_p(n)\|^2 + \|G_c\cdot e_c(n)\|^2} \tag{2}$$

In (2), $e_p(n)$ and $e_c(n)$ are excitation component signals and will be described further below. In various applications, some variants of Equations (1) and (2) may be used but they can still represent signal periodicity.

The most popular spectral tilt parameter is provided below in Equation (3).

$$P^1_{tilt} = \frac{\sum_n s(n)\cdot s(n-1)}{\sqrt{\sum_n |s(n)|^2}} = \frac{\langle s(n), s(n-1)\rangle}{\sqrt{\|s_w(n)\|^2}} \tag{3}$$

In Equation (3), s(n) is speech signal. If frequency domain energy is available, the spectral tilt parameter can be as described in Equation (4).

$$P^2_{tilt} = \frac{E_{LB} - E_{HB}}{E_{LB} + E_{HB}} \tag{4}$$

In Equation (4), $E_{LB}$ is the low frequency band energy and $E_{HB}$ is the high frequency band energy.

Another parameter which can reflect spectral tilt is called Zero-Cross Rate (ZCR). ZCR counts positive/negative signal change rate on a frame or subframe. Usually, when high frequency band energy is high relative to low frequency band energy, ZCR is also high. Otherwise, when high frequency band energy is low relative to low frequency band energy, ZCR is also low. In real applications, some variants of Equations (3) and (4) may be used but they can still represent spectral tilt.

As mentioned previously, Unvoiced/Voiced classification or Unvoiced/Voiced Decision is widely used in the field of speech signal coding, speech signal bandwidth extension (BWE), speech signal enhancement and speech signal background noise reduction (NR).

In speech coding, unvoiced speech signal may be coded by using noise-like excitation and voiced speech signal may be coded with pulse-like excitation as will be illustrated subsequently. In speech signal bandwidth extension, the extended high band signal energy of unvoiced speech signal may be increased while the extended high band signal energy of voiced speech signal may be reduced. In speech signal background noise reduction (NR), NR algorithm may be less aggressive for unvoiced speech signal and more aggressive for voiced speech signal. So, a robust Unvoiced or Voiced Decision is important for the above kinds of applications. Based on the characteristics of unvoiced speech and voiced speech, both the periodicity parameter $P_{voicing}$ and the spectral tilt parameter $P_{tilt}$ or their variants parameters are mostly used to detect Unvoiced/Voiced classes. However, the inventors of this application have identified that the "absolute" values of the periodicity parameter $P_{voicing}$ and the spectral tilt parameter $P_{tilt}$ or their variants parameters are influenced by speech signal recording equipment, background noise level, and/or speakers. Those influences are difficult to be pre-determined, possibly resulting in a un-robust Unvoiced/Voiced speech detection.

Embodiments of the present invention describe an improved Unvoiced/Voiced speech detection which uses the "relative" values of the periodicity parameter $P_{voicing}$ and the spectral tilt parameter $P_{tilt}$ or their variants parameters instead of the "absolute" values. The "relative" values are much less influenced than the "absolute" values by speech signal recording equipment, background noise level, and/or speakers, resulting in a more robust Unvoiced/Voiced speech detection.

For example, a combined unvoicing parameter could be defined as in Equation (5) below.

$$P_{c_unvoicing}=(1-P_{voicing})\cdot(1-P_{tilt}) \tag{5}$$

The dots at the end of Equation (11) indicate other parameters may be added. When the "absolute" value of $P_{c_unvoicing}$ becomes large, it is likely unvoiced speech signal. A combined voicing parameter could be described as in Equation (6) below.

$$P_{c_voicing}=P_{voicing}\cdot P_{tilt} \tag{6}$$

The dots at the end of Equation (6) similarly indicate that other parameters may be added. When the "absolute" value of $P_{c_voicing}$ becomes large, it is likely voiced speech signal. Before the "relative" values of $P_{c_unvoicing}$ or $P_{c_voicing}$ are defined, a strongly smoothed parameter of $P_{c_unvoicing}$ or $P_{c_voicing}$ is defined first. For example, the parameter for current frame may be smoothed from a previous frame as described by inequality below in Equation (7).

```
if (P_c_unvoicing_sm > P_c_unvoicing) {
    P_c_unvoicing_sm ⇐ 0.9 P_c_unvoicing_sm + 0.1 P_c_unvoicing
}
else {
    P_c_unvoicing_sm ⇐ 0.99 P_c_unvoicing_sm + 0.01 P_c_unvoicing
}
```
(7)

In Equation (7), $P_{c_unvoicing_sm}$ is a strongly smoothed value of $P_{c_unvoicing}$.

Similarly, the smoothed combined voicing parameter $P_{c_voicing_sm}$ may be determined using the inequality below using Equation (8).

```
if (P_c_unvoicing_sm > P_c_unvoicing ) {
    P_c_unvoicing_sm ⇐ (7/8) P_c_unvoicing_sm + (1/8) P_c_unvoicing
}
else {
    P_c_unvoicing_sm ⇐ (255/256) P_c_unvoicing_sm + (1/256) P_c_unvoicing
}
```
(8)

Here, in Equation (8), $P_{c_voicing_sm}$ is a strongly smoothed value of $P_{c_voicing}$.

The statistical behavior of Voiced speech is different from that of Unvoiced speech, and therefore in various embodiments, the parameters for deciding the above inequality (e.g., 0.9, 0.99, 7/8, 255/256) may be decided and further refined if necessary based on experiments.

The "relative" values of $P_{c_unvoicing}$ or $P_{c_voicing}$ may be defined as in Equations (9) and (10) described below.

$$P_{c_unvoicing_diff}=P_{c_unvoicing}-P_{c_unvoicing_sm} \tag{9}$$

$P_{c_unvoicing_diff}$ is the "relative" value of $P_{c_unvoicing}$; similarly, $$P_{c_voicing_diff}=P_{c_voicing}-P_{c_voicing_sm} \tag{10}$$

$P_{c_voicing_diff}$ is the "relative" value of $P_{c_voicing}$.

The inequality below is an example embodiment of applying an Unvoiced detection. In this example embodiment, setting the flag Unvoiced_flag to be TRUE indicates that the speech signal is an unvoiced speech while setting the flag Unvoiced_flag to be FALSE indicates that the speech signal is not unvoiced speech.

```
if (P_c_unvoicing_diff > 0.1) {
    Unvoiced _flag = TRUE;
}
else if (P_c_unvoicing_diff < 0.05) {
    Unvoiced _flag = FALSE;
}
else {
    Unvoiced _flag is not changed (previous Unvoiced _flag is kept).
}
```

The inequality below is an alternative example embodiment of applying an Voiced detection. In this example embodiment, setting Voiced_flag as being TRUE indicates that the speech signal is voiced speech whereas setting Voiced_flag to be FALSE indicates that the speech signal is not voiced speech.

```
if (P_c_unvoicing_diff > 0.1) {
    Voiced _flag = TRUE;
}
else if (P_c_unvoicing_diff < 0.05) {
    Voiced _flag = FALSE;
}
else {
    Voiced _flag is not changed (previous Voiced _flag is kept).
}
```

After identifying the speech signal to be from a VOICED class, the speech signal may then be coded with time domain coding approach such as CELP. Embodiments of the present invention may also be applied to re-classify an UNVOICED signal to a VOICED signal prior to encoding.

In various embodiments, the above improved Unvoiced/Voiced Detection algorithm may be used to improve AMR-WB-BWE and NR.

Figure 3:
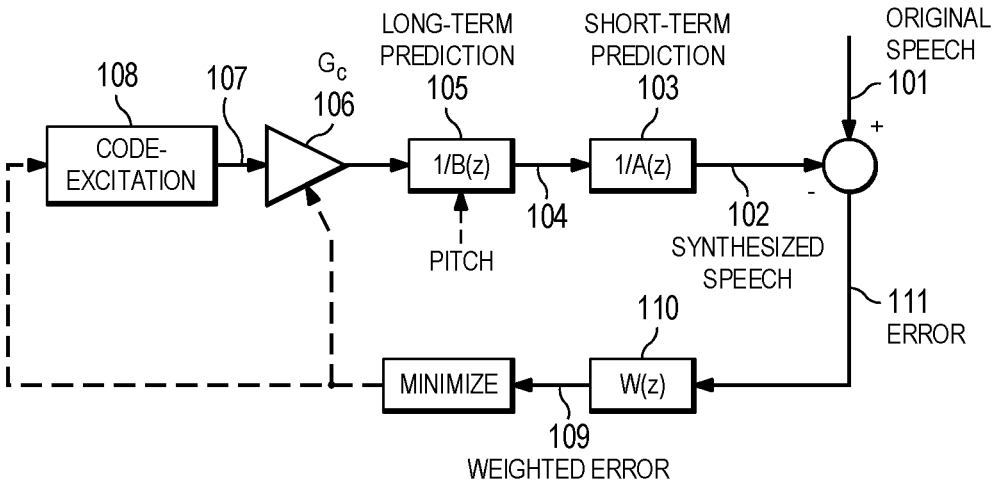
FIG. 3 illustrates operations performed during encoding of an original speech using a conventional CELP encoder implementing an embodiment of the present invention.

FIG. 3 illustrates operations performed during encoding of an original speech using a conventional CELP encoder implementing an embodiment of the present invention.

FIG. 3 illustrates a conventional initial CELP encoder where a weighted error 109 between a synthesized speech 102 and an original speech 101 is minimized often by using an analysis-by-synthesis approach, which means that the encoding (analysis) is performed by perceptually optimizing the decoded (synthesis) signal in a closed loop.

The basic principle that all speech coders exploit is the fact that speech signals are highly correlated waveforms. As an illustration, speech can be represented using an autoregressive (AR) model as in Equation (11) below.

$$X_n = \sum_{i=1}^{L} a_i X_{n-1} + e_n \tag{11}$$

In Equation (11), each sample is represented as a linear combination of the previous L samples plus a white noise. The weighting coefficients $a_1, a_2, \ldots a_L$, are called Linear Prediction Coefficients (LPCs). For each frame, the weighting coefficients $a_1, a_2, \ldots a_L$, are chosen so that the spectrum of $\{X_1, X_2, \ldots, X_N\}$, generated using the above model, closely matches the spectrum of the input speech frame.

Alternatively, speech signals may also be represented by a combination of a harmonic model and noise model. The harmonic part of the model is effectively a Fourier series representation of the periodic component of the signal. In general, for voiced signals, the harmonic plus noise model of speech is composed of a mixture of both harmonics and noise. The proportion of harmonic and noise in a voiced speech depends on a number of factors including the speaker characteristics (e.g., to what extent a speaker's voice is normal or breathy); the speech segment character (e.g. to what extent a speech segment is periodic) and on the frequency. The higher frequencies of voiced speech have a higher proportion of noise-like components.

Linear prediction model and harmonic noise model are the two main methods for modelling and coding of speech signals. Linear prediction model is particularly good at modelling the spectral envelop of speech whereas harmonic noise model is good at modelling the fine structure of speech. The two methods may be combined to take advantage of their relative strengths.

As indicated previously, before CELP coding, the input signal to the handset's microphone is filtered and sampled, for example, at a rate of 8000 samples per second. Each sample is then quantized, for example, with 13 bit per sample. The sampled speech is segmented into segments or frames of 20 ms (e.g., in this case 160 samples).

The speech signal is analyzed and its LP model, excitation signals and pitch are extracted. The LP model represents the spectral envelop of speech. It is converted to a set of line spectral frequencies (LSF) coefficients, which is an alternative representation of linear prediction parameters, because LSF coefficients have good quantization properties. The LSF coefficients can be scalar quantized or more efficiently they can be vector quantized using previously trained LSF vector codebooks.

The code-excitation includes a codebook comprising codevectors, which have components that are all independently chosen so that each codevector may have an approximately 'white' spectrum. For each subframe of input speech, each of the codevectors is filtered through the short-term linear prediction filter 103 and the long-term prediction filter 105, and the output is compared to the speech samples. At each subframe, the codevector whose output best matches the input speech (minimized error) is chosen to represent that subframe.

The coded excitation 108 normally comprises pulse-like signal or noise-like signal, which are mathematically constructed or saved in a codebook. The codebook is available to both the encoder and the receiving decoder. The coded excitation 108, which may be a stochastic or fixed codebook, may be a vector quantization dictionary that is (implicitly or explicitly) hard-coded into the codec. Such a fixed codebook may be an algebraic code-excited linear prediction or be stored explicitly.

A codevector from the codebook is scaled by an appropriate gain to make the energy equal to the energy of the input speech. Accordingly, the output of the coded excitation 108 is scaled by a gain $G_c$ 107 before going through the linear filters.

The short-term linear prediction filter 103 shapes the 'white' spectrum of the codevector to resemble the spectrum of the input speech. Equivalently, in time-domain, the short-term linear prediction filter 103 incorporates short-term correlations (correlation with previous samples) in the white sequence. The filter that shapes the excitation has an all-pole model of the form 1/A(z) (short-term linear prediction filter 103), where A(z) is called the prediction filter and may be obtained using linear prediction (e.g., Levinson-Durbin algorithm). In one or more embodiments, an all-pole filter may be used because it is a good representation of the human vocal tract and because it is easy to compute.

The short-term linear prediction filter 103 is obtained by analyzing the original signal 101 and represented by a set of coefficients:

$$A(z) = \sum_{i=1}^{P} 1 + a_i \cdot z^{-i},\ i = 1, 2, \ldots, P \tag{12}$$

As previously described, regions of voiced speech exhibit long term periodicity. This period, known as pitch, is introduced into the synthesized spectrum by the pitch filter 1/(B(z)). The output of the long-term prediction filter 105 depends on pitch and pitch gain. In one or more embodiments, the pitch may be estimated from the original signal, residual signal, or weighted original signal. In one embodiment, the long-term prediction function (B(z)) may be expressed using Equation (13) as follows.

$$B(z)=1-G_p \cdot z^{-Pitch} \tag{13}$$

The weighting filter 110 is related to the above short-term prediction filter. One of the typical weighting filters may be represented as described in Equation (14).

$$W(z) = \frac{A(z/\alpha)}{1-\beta \cdot z^{-1}} \tag{14}$$

where $\beta<\alpha$, $0<\beta<1$, $0<\alpha\leq 1$.

In another embodiment, the weighting filter W(z) may be derived from the LPC filter by the use of bandwidth expansion as illustrated in one embodiment in Equation (15) below.

$$W(z) = \frac{A(z/\gamma 1)}{A(z/\gamma 2)}, \tag{15}$$

In Equation (15), $\gamma 1 > \gamma 2$, which are the factors with which the poles are moved towards the origin.

Accordingly, for every frame of speech, the LPCs and pitch are computed and the filters are updated. For every subframe of speech, the codevector that produces the 'best' filtered output is chosen to represent the subframe. The corresponding quantized value of gain has to be transmitted to the decoder for proper decoding. The LPCs and the pitch values also have to be quantized and sent every frame for reconstructing the filters at the decoder. Accordingly, the coded excitation index, quantized gain index, quantized long-term prediction parameter index, and quantized short-term prediction parameter index are transmitted to the decoder.

Figure 4:
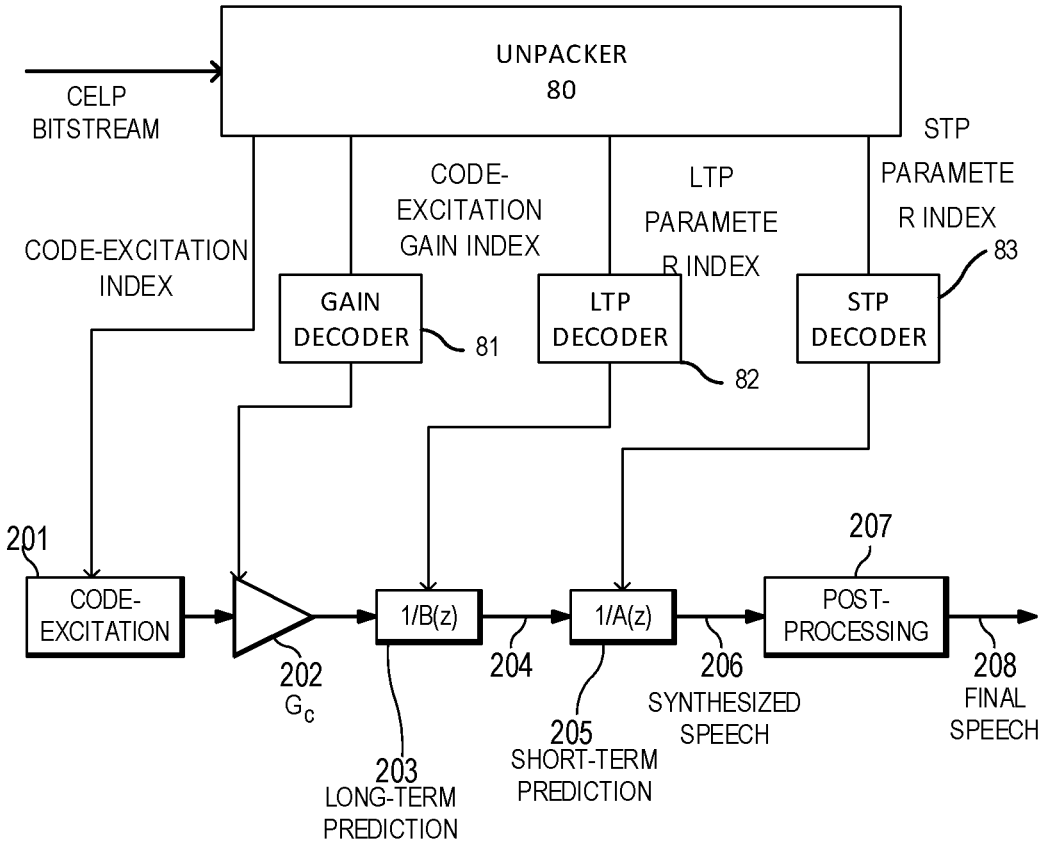
FIG. 4 illustrates operations performed during decoding of an original speech using a conventional CELP decoder implementing an embodiment of the present invention.

FIG. 4 illustrates operations performed during decoding of an original speech using a CELP decoder in accordance with an embodiment of the present invention.

The speech signal is reconstructed at the decoder by passing the received codevectors through the corresponding filters. Consequently, every block except post-processing has the same definition as described in the encoder of FIG. 3.

The coded CELP bitstream is received and unpacked 80 at a receiving device. For each subframe received, the received coded excitation index, quantized gain index, quantized long-term prediction parameter index, and quantized short-term prediction parameter index, are used to find the corresponding parameters using corresponding decoders, for example, gain decoder 81, long-term prediction decoder 82, and short-term prediction decoder 83. For example, the positions and amplitude signs of the excitation pulses and the algebraic code vector of the code-excitation 402 may be determined from the received coded excitation index.

Referring to FIG. 4, the decoder is a combination of several blocks which includes coded excitation 201, long-term prediction 203, short-term prediction 205. The initial decoder further includes post-processing block 207 after a synthesized speech 206. The post-processing may further comprise short-term post-processing and long-term post-processing.

Figure 5:
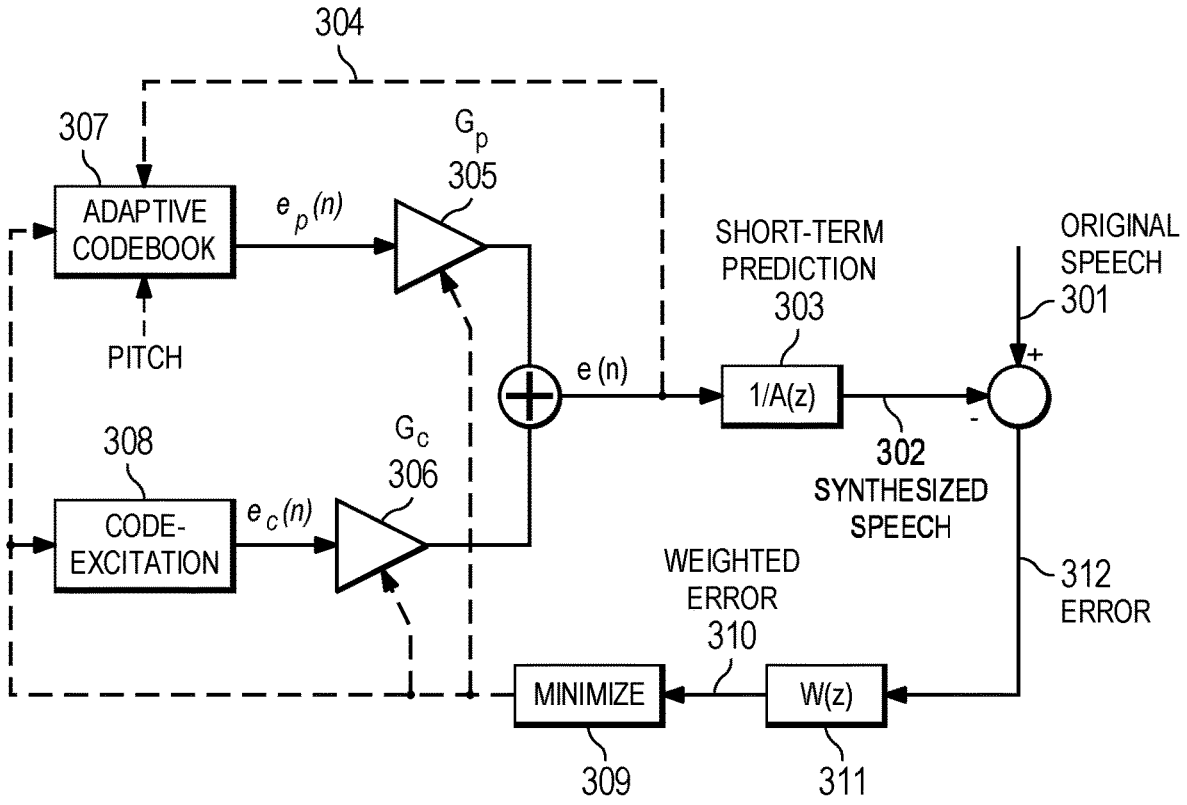
FIG. 5 illustrates a conventional CELP encoder used in implementing embodiments of the present invention.

FIG. 5 illustrates a conventional CELP encoder used in implementing embodiments of the present invention.

FIG. 5 illustrates a basic CELP encoder using an additional adaptive codebook for improving long-term linear prediction. The excitation is produced by summing the contributions from an adaptive codebook 307 and a code excitation 308, which may be a stochastic or fixed codebook as described previously. The entries in the adaptive codebook comprise delayed versions of the excitation. This makes it possible to efficiently code periodic signals such as voiced sounds.

Referring to FIG. 5, an adaptive codebook 307 comprises a past synthesized excitation 304 or repeating past excitation pitch cycle at pitch period. Pitch lag may be encoded in integer value when it is large or long. Pitch lag is often encoded in more precise fractional value when it is small or short. The periodic information of pitch is employed to generate the adaptive component of the excitation. This excitation component is then scaled by a gain $G_p$ 305 (also called pitch gain).

Long-Term Prediction plays a very important role for voiced speech coding because voiced speech has strong periodicity. The adjacent pitch cycles of voiced speech are similar to each other, which means mathematically the pitch gain $G_p$ in the following excitation express is high or close to 1. The resulting excitation may be expressed as in Equation (16) as combination of the individual excitations.

$$e(n)=G_p \cdot e_p(n)+G_c \cdot e_c(n) \tag{16}$$

where, $e_p(n)$ is one subframe of sample series indexed by n, coming from the adaptive codebook 307 which comprises the past excitation 304 through the feedback loop (FIG. 5). $e_p(n)$ may be adaptively low-pass filtered as the low frequency area is often more periodic or more harmonic than high frequency area. $e_c(n)$ is from the coded excitation codebook 308 (also called fixed codebook) which is a current excitation contribution. Further, $e_c(n)$ may also be enhanced such as by using high pass filtering enhancement, pitch enhancement, dispersion enhancement, formant enhancement, and others.

For voiced speech, the contribution of $e_p(n)$ from the adaptive codebook 307 may be dominant and the pitch gain $G_p$ 305 is around a value of 1. The excitation is usually updated for each subframe. Typical frame size is 20 milliseconds and typical subframe size is 5 milliseconds.

As described in FIG. 3, the fixed coded excitation 308 is scaled by a gain $G_c$ 306 before going through the linear filters. The two scaled excitation components from the fixed coded excitation 108 and the adaptive codebook 307 are added together before filtering through the short-term linear prediction filter 303. The two gains ($G_p$ and $G_c$) are quantized and transmitted to a decoder. Accordingly, the coded excitation index, adaptive codebook index, quantized gain indices, and quantized short-term prediction parameter index are transmitted to the receiving audio device.

Figure 6:
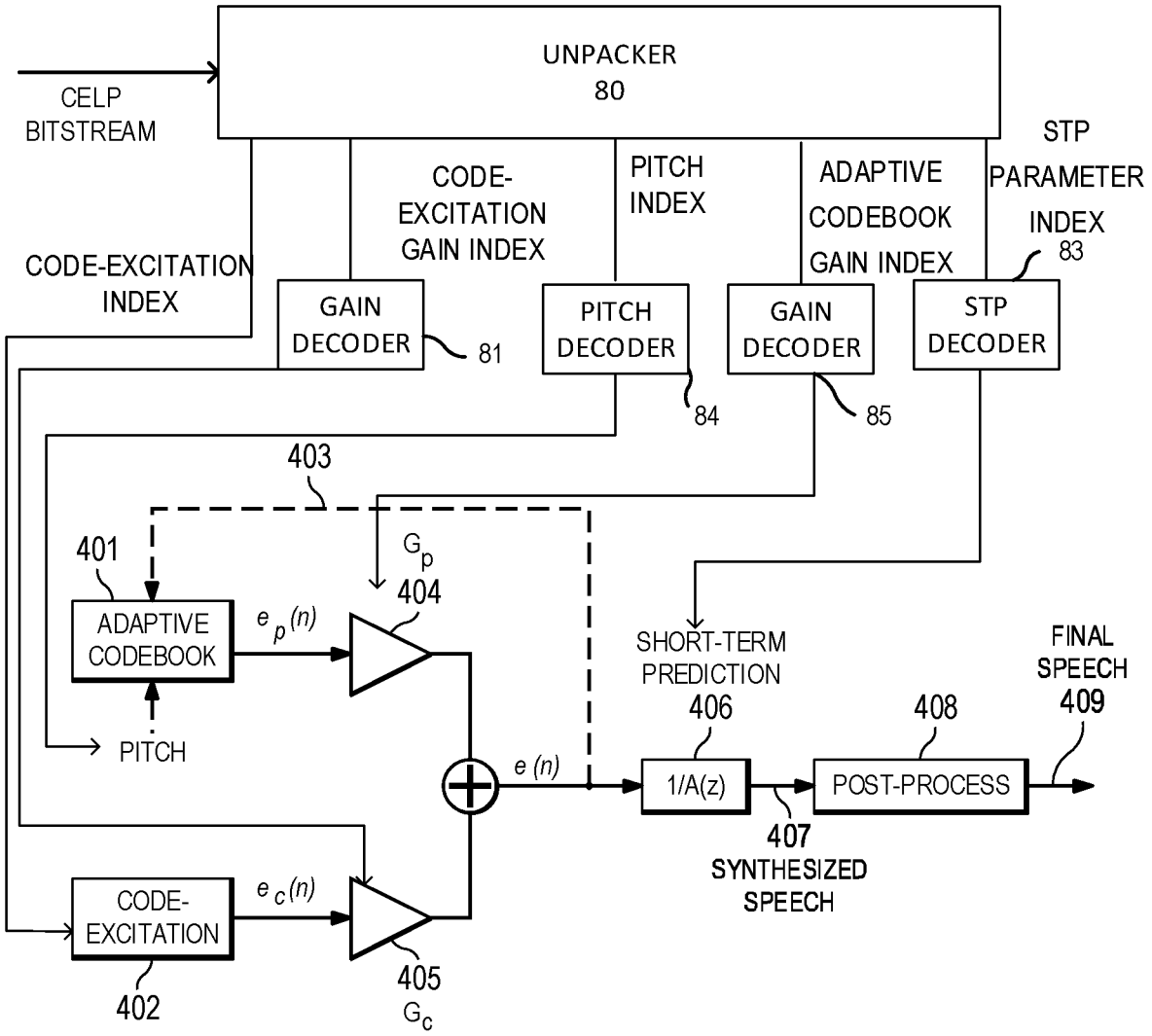
FIG. 6 illustrates a basic CELP decoder corresponding to the encoder in FIG. 5 in accordance with an embodiment of the present invention.

The CELP bitstream coded using a device illustrated in FIG. 5 is received at a receiving device. FIG. 6 illustrate the corresponding decoder of the receiving device.

FIG. 6 illustrates a basic CELP decoder corresponding to the encoder in FIG. 5 in accordance with an embodiment of the present invention. FIG. 6 includes a post-processing block 408 receiving the synthesized speech 407 from the main decoder. This decoder is similar to FIG. 2 except the adaptive codebook 307.

For each subframe received, the received coded excitation index, quantized coded excitation gain index, quantized pitch index, quantized adaptive codebook gain index, and quantized short-term prediction parameter index, are used to find the corresponding parameters using corresponding decoders, for example, gain decoder 81, pitch decoder 84, adaptive codebook gain decoder 85, and short-term prediction decoder 83.

In various embodiments, the CELP decoder is a combination of several blocks and comprises coded excitation 402, adaptive codebook 401, short-term prediction 406, and post-processing 408. Every block except post-processing has the same definition as described in the encoder of FIG. 5. The post-processing may further include short-term post-processing and long-term post-processing.

As already mentioned, CELP is mainly used to encode speech signal by benefiting from specific human voice characteristics or human vocal voice production model. In order to encode speech signal more efficiently, speech signal may be classified into different classes and each class is encoded in a different way. Voiced/Unvoiced classification or Unvoiced Decision may be an important and basic classification among all the classifications of different classes. For each class, LPC or STP filter is always used to represent the spectral envelope. But the excitation to the LPC filter may be different. Unvoiced signals may be coded with a noise-like excitation. On the other hand, voiced signals may be coded with a pulse-like excitation.

The code-excitation block (referenced with label 308 in FIG. 5 and 402 in FIG. 6) illustrates the location of Fixed Codebook (FCB) for a general CELP coding. A selected code vector from FCB is scaled by a gain often noted as $G_c$ 306.

Figure 7:
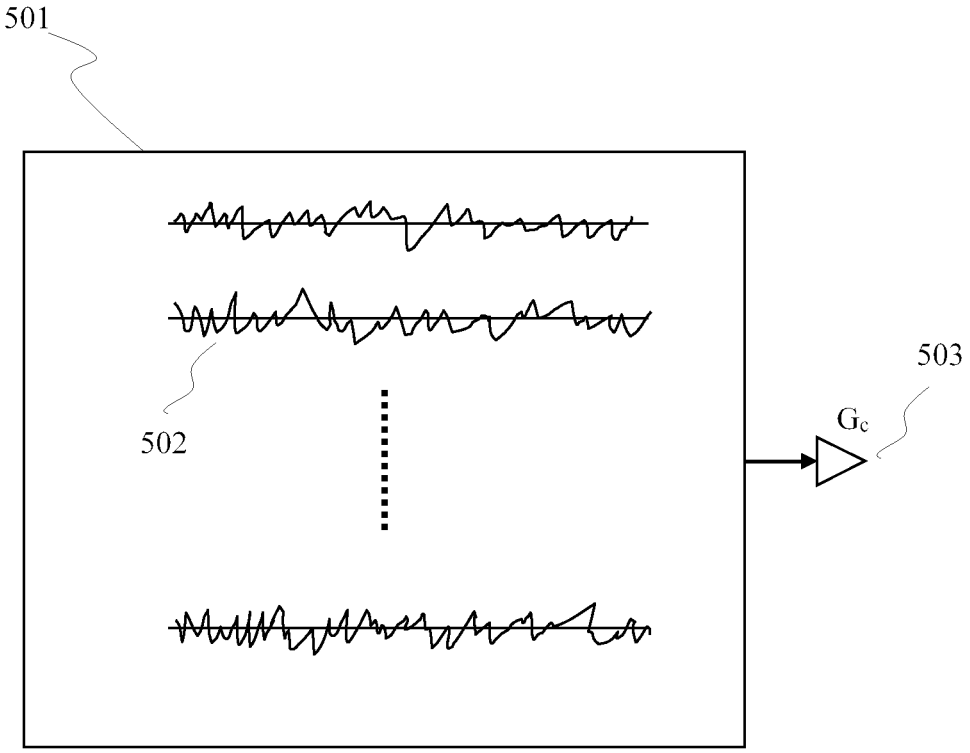
FIG. 7 illustrates noise-like candidate vectors for constructing coded excitation codebook or fixed codebook of CELP speech coding.

FIG. 7 illustrates noise-like candidate vectors for constructing coded excitation codebook or fixed codebook of CELP speech coding.

An FCB containing noise-like vectors may be the best structure for unvoiced signals from perceptual quality point of view. This is because the adaptive codebook contribution or LTP contribution would be small or non-existent, and the main excitation contribution relies on the FCB component for unvoiced class signal. In this case, if a pulse-like FCB is used, the output synthesized speech signal could sound spiky as there are a lot of zeros in the code vector selected from the pulse-like FCB designed for low bit rates coding.

Referring to FIG. 7, an FCB structure which includes noise-like candidate vectors for constructing a coded excitation. The noise-like FCB 501 selects a particular noise-like code vector 502, which is scaled by the gain 503.

Figure 8:
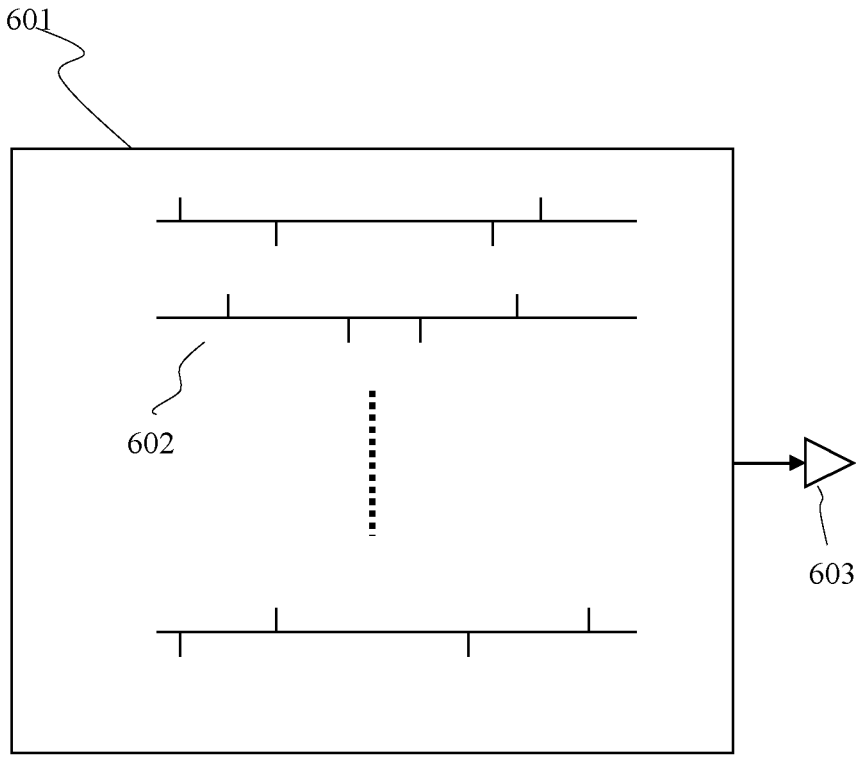
FIG. 8 illustrates pulse-like candidate vectors for constructing coded excitation codebook or fixed codebook of CELP speech coding.

FIG. 8 illustrates pulse-like candidate vectors for constructing coded excitation codebook or fixed codebook of CELP speech coding.

A pulse-like FCB provides better quality than a noise-like FCB for voiced class signal from perceptual point of view. This is because the adaptive codebook contribution or LTP contribution would be dominant for the highly periodic voiced class signal and the main excitation contribution does not rely on the FCB component for the voiced class signal. If a noise-like FCB is used, the output synthesized speech signal may sound noisy or less periodic as it is more difficult to have a good waveform matching by using the code vector selected from the noise-like FCB designed for low bit rates coding.

Referring to FIG. 8, an FCB structure may include a plurality of pulse-like candidate vectors for constructing a coded excitation. A pulse-like code vector 602 is selected from the pulse-like FCB 601 and scaled by the gain 603.

Figure 9:
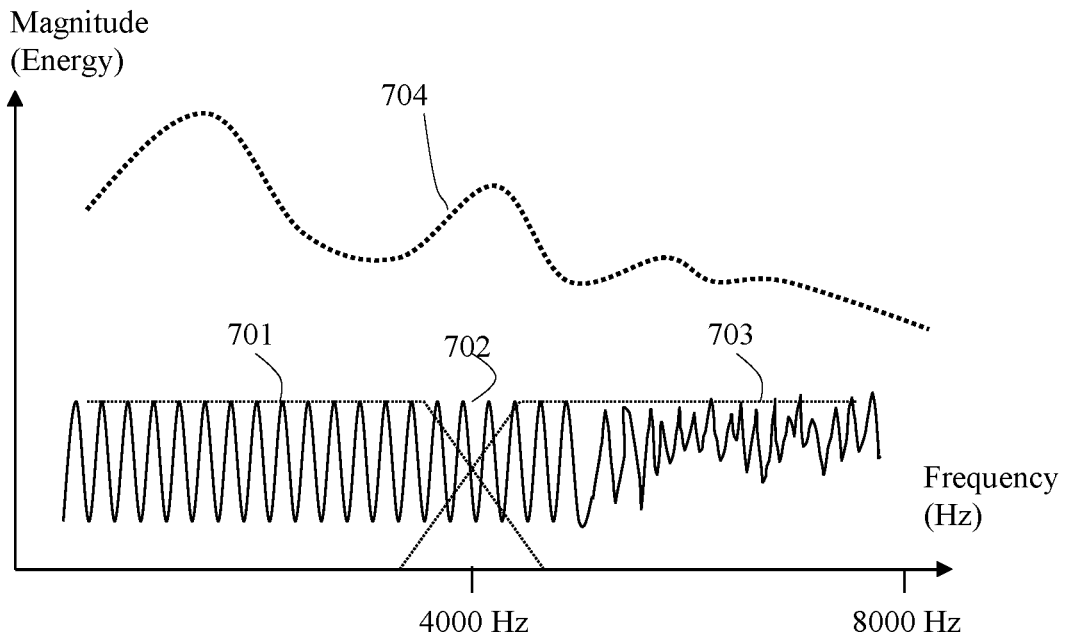
FIG. 9 illustrates an example of excitation spectrum for voiced speech.

FIG. 9 illustrates an example of excitation spectrum for voiced speech. After removing the LPC spectral envelope 704, the excitation spectrum 702 is almost flat. Low band excitation spectrum 701 is usually more harmonic than high band spectrum 703. Theoretically, the ideal or unquantized high band excitation spectrum could have almost the same energy level as the low band excitation spectrum. In practice, if both the low band and high band are encoded with CELP technology, the synthesized or quantized high band spectrum could have a lower energy level than the synthesized or quantized low band spectrum for at least two reasons. First, the closed-loop CELP coding emphasizes more on the low band than the high band. Second, the waveform matching for the low band signal is easier than the high band signal, not only due to the faster changing of the high band signal but also due to the more noise-like characteristic of the high band signal.

In low bit rate CELP coding such as AMR-WB, the high band is usually not encoded but generated in the decoder with a band width extension (BWE) technology. In this case, the high band excitation spectrum may be simply copied from the low band excitation spectrum while adding some random noise. The high band spectral energy envelope may be predicted or estimated from the low band spectral energy envelope. Proper control of the high band signal energy becomes important when BWE is used. Unlike unvoiced speech signal, the energy of the generated high band voiced speech signal has to be reduced properly to achieve the best perceptual quality.

Figure 10:
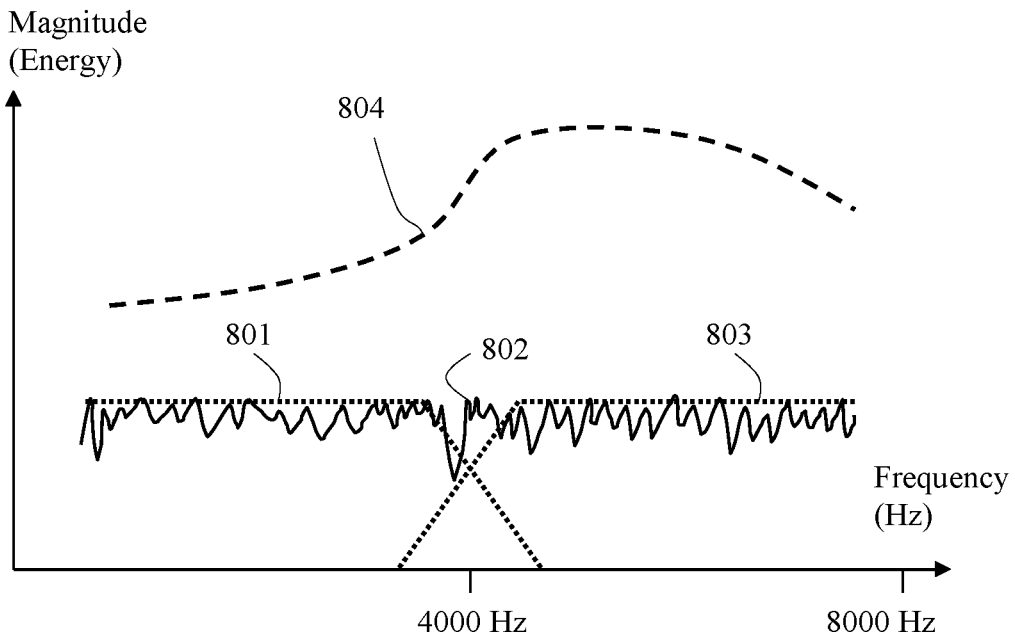
FIG. 10 illustrates an example of an excitation spectrum for unvoiced speech.

FIG. 10 illustrates an example of an excitation spectrum for unvoiced speech.

In case of unvoiced speech, the excitation spectrum 802 is almost flat after removing the LPC spectral envelope 804. Both the low band excitation spectrum 801 and the high band spectrum 803 are noise-like. Theoretically, the ideal or unquantized high band excitation spectrum could have almost the same energy level as the low band excitation spectrum. In practice, if both the low band and high band are encoded with CELP technology, the synthesized or quantized high band spectrum could have the same or slightly higher energy level than the synthesized or quantized low band spectrum for two reasons. First, the closed-loop CELP coding emphasizes more on the higher energy area. Second, although the waveform matching for the low band signal is easier than the high band signal, it is always difficult to have a good waveform matching for noise-like signals.

Similar to voiced speech coding, for unvoiced low bit rate CELP coding such as AMR-WB, the high band is usually not encoded but generated in the decoder with an BWE technology. In this case, the unvoiced high band excitation spectrum may be simply copied from the unvoiced low band excitation spectrum while adding some random noise. The high band spectral energy envelope of unvoiced speech signal may be predicted or estimated from the low band spectral energy envelope. Controlling the energy of the unvoiced high band signal properly is especially important when the BWE is used. Unlike voiced speech signal, the energy of the generated high band unvoiced speech signal is better to be increased properly to achieve a best perceptual quality.

Figure 11:
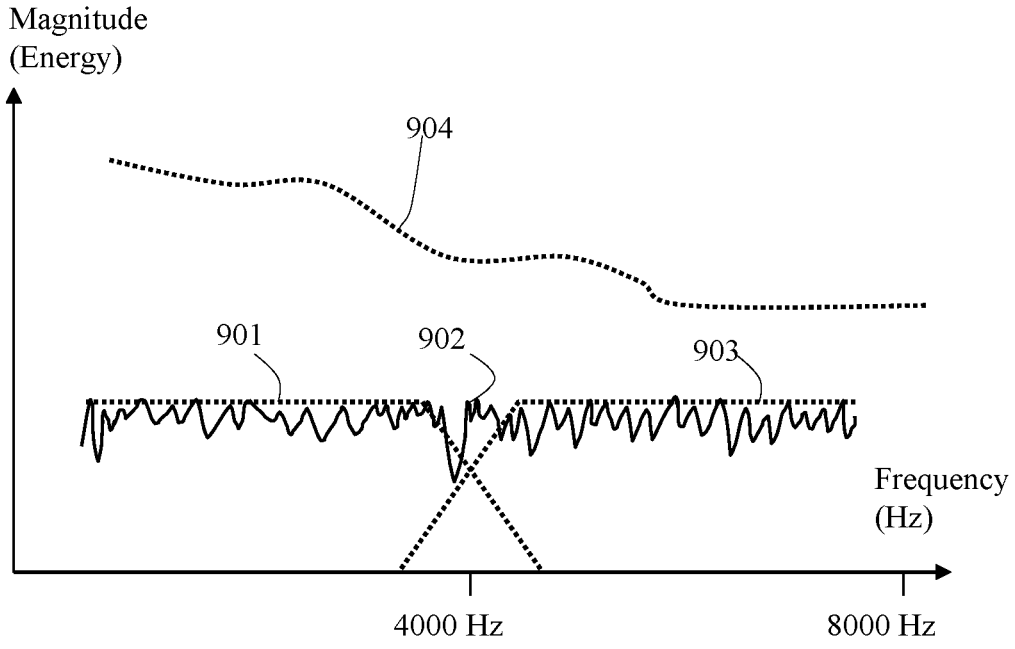
FIG. 11 illustrates an example of excitation spectrum for background noise signal.

FIG. 11 illustrates an example of excitation spectrum for background noise signal.

The excitation spectrum 902 is almost flat after removing the LPC spectral envelope 904. The low band excitation spectrum 901, which is usually noise-like as high band spectrum 903. Theoretically, the ideal or unquantized high band excitation spectrum of background noise signal could have almost the same energy level as the low band excitation spectrum. In practice, if both the low band and high band are encoded with CELP technology, the synthesized or quantized high band spectrum of background noise signal could have a lower energy level than the synthesized or quantized low band spectrum for two reasons. First, the closed-loop CELP coding emphasizes more on the low band which has higher energy than the high band. Second, the waveform matching for the low band signal is easier than the high band signal. Similar to speech coding, for low bit rate CELP coding of background noise signal, the high band is usually not encoded but generated in the decoder with an BWE technology. In this case, the high band excitation spectrum of background noise signal may be simply copied from the low band excitation spectrum while adding some random noise; the high band spectral energy envelope of background noise signal may be predicted or estimated from the low band spectral energy envelope. The control of the high band background noise signal may be different from speech signal when the BWE is used. Unlike speech signal, the energy of the generated high band background noise speech signal is better to be stable over time to achieve a best perceptual quality.

Figure 12A:
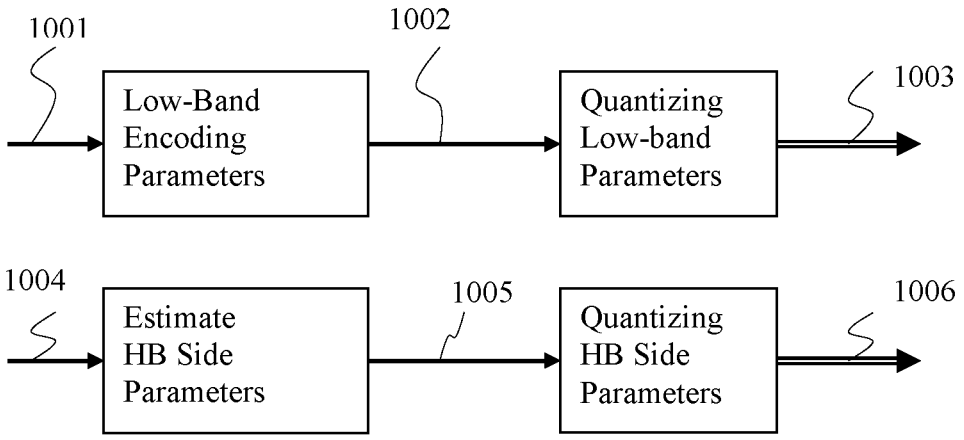
Figure 12B:
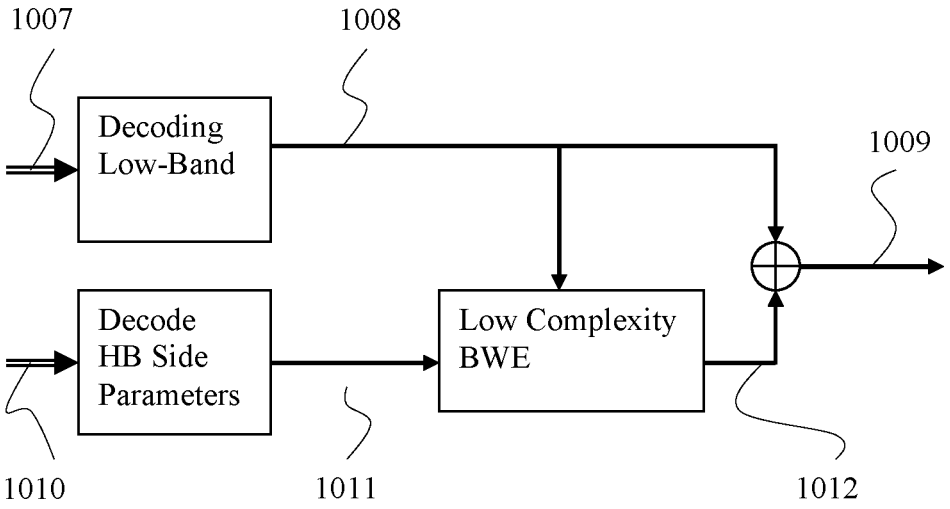

FIGS. 12A and 12B illustrate examples of frequency domain encoding/decoding with bandwidth extension. FIG. 12A illustrates the encoder with BWE side information while FIG. 12B illustrates the decoder with BWE.

Referring first to FIG. 12A, the low band signal 1001 is encoded in frequency domain by using low band parameters 1002. The low band parameters 1002 are quantized and the quantization index is transmitted to a receiving audio access device through the bitstream channel 1003. The high band signal extracted from audio signal 1004 is encoded with small amount of bits by using the high band side parameters 1005. The quantized high band side parameters (HB side information index) are transmitted to the receiving audio access device through the bitstream channel 1006.

Referring to FIG. 12B, at the decoder, the low band bitstream 1007 is used to produce a decoded low band signal 1008. The high band side bitstream 1010 is used to decode and generate the high band side parameters 1011. The high band signal 1012 is generated from the low band signal 1008 with help from the high band side parameters 1011. The final audio signal 1009 is produced by combining the low band signal and the high band signal. The frequency domain BWE also needs a proper energy controlling of the generated high band signal. The energy levels may be set differently for Unvoiced, Voiced and Noise signals. So, a high quality classification of speech signal is also needed for the frequency domain BWE.

Relevant details of the background noise reduction algorithm are described below. In general, because unvoiced speech signal is noise-like, background noise reduction (NR) in unvoiced area should be less aggressive than voiced area, benefiting from noise masking effect. In other words, a same level background noise is more audible in voiced area than unvoiced area so that NR should be more aggressive in voiced area than unvoiced area. In such a case, a high quality Unvoiced/Voiced decision is needed.

In general, unvoiced speech signal is noise-like signal which has no periodicity. Further, unvoiced speech signal has more energy in high frequency area than low frequency area. In contrast, voiced speech signal has opposite characteristics. For example, voiced speech signal is a quasi-periodic type of signal, which usually has more energy in low frequency area than high frequency area (see also FIGS. 9 and 10).

Figure 13A:
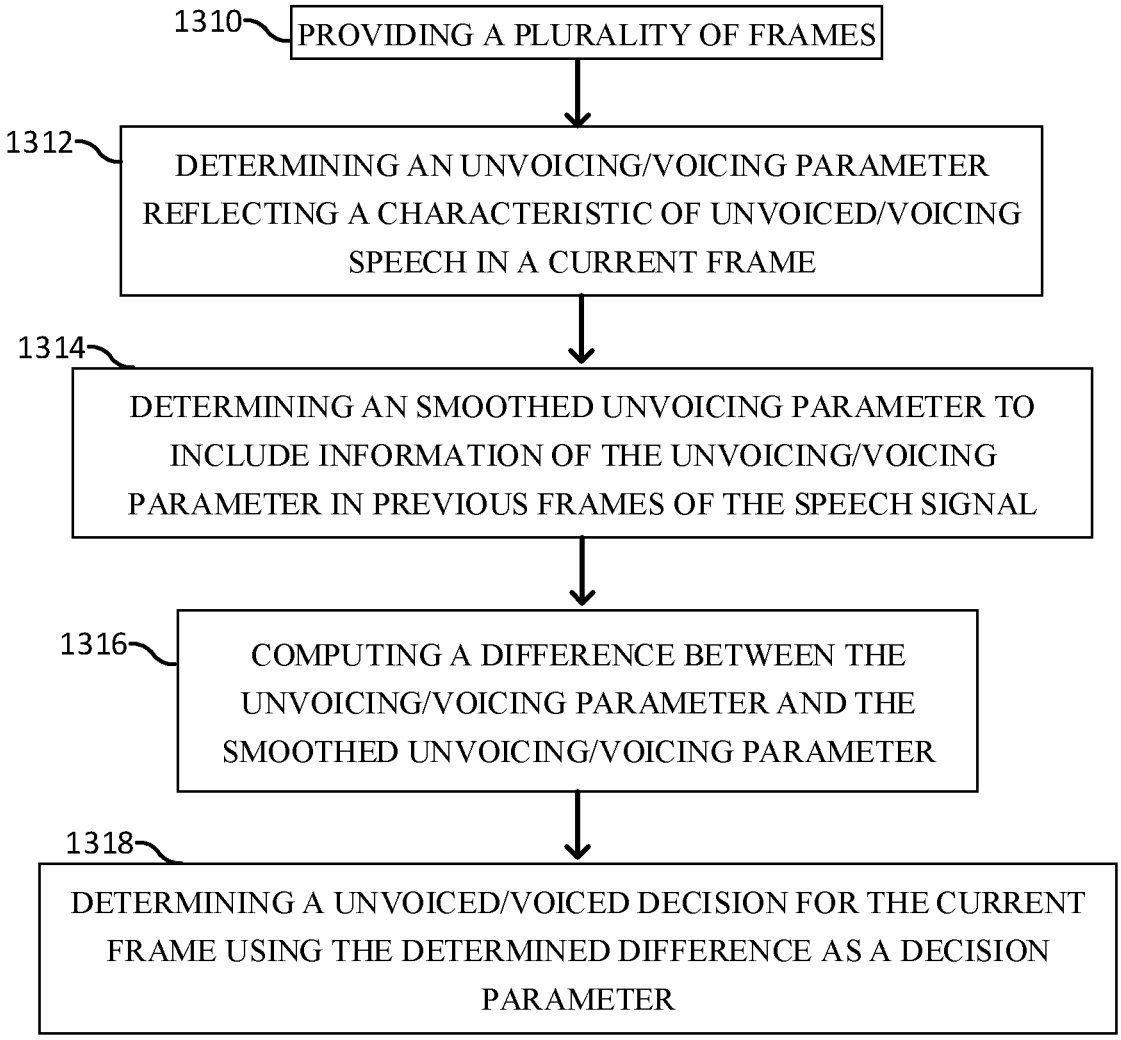
FIGS. 13A-13C describe speech processing operations in accordance with various embodiments described above.
Figure 13B:
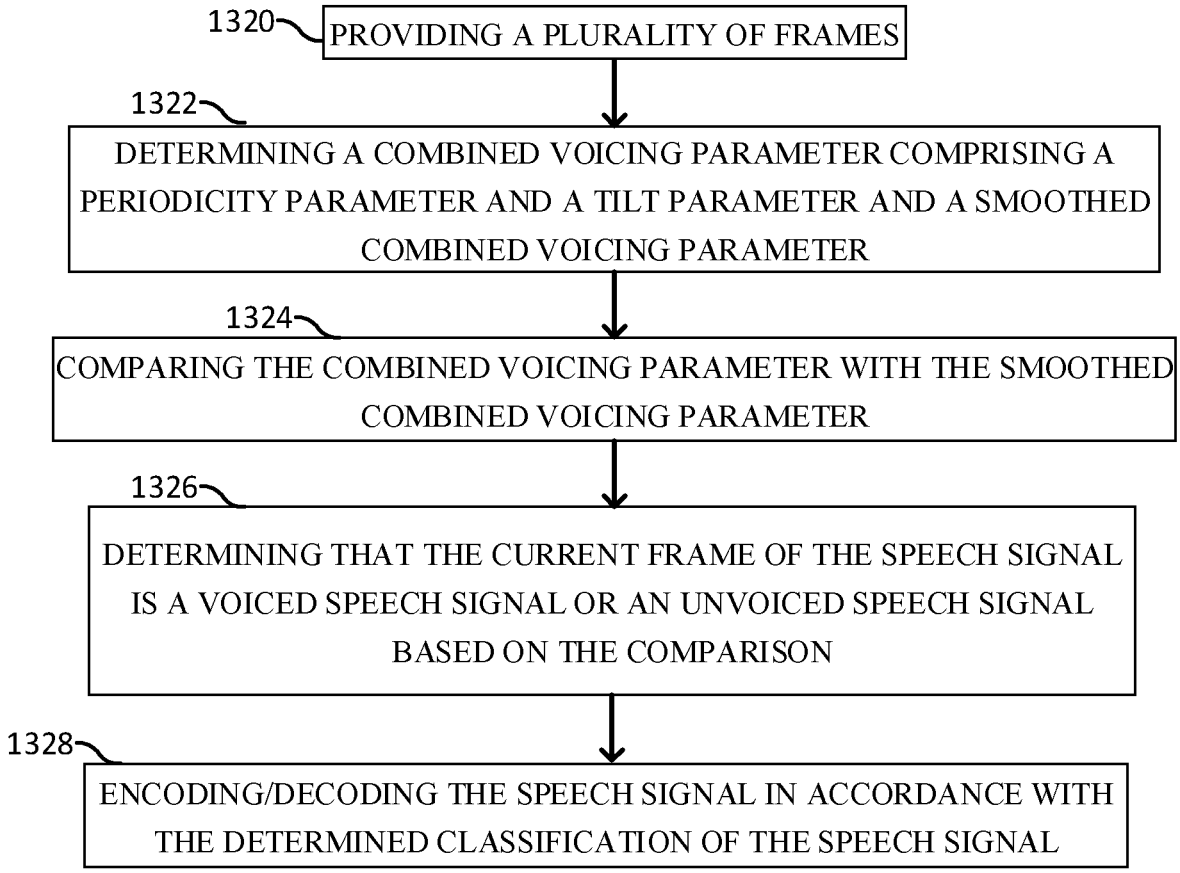
Figure 13C:
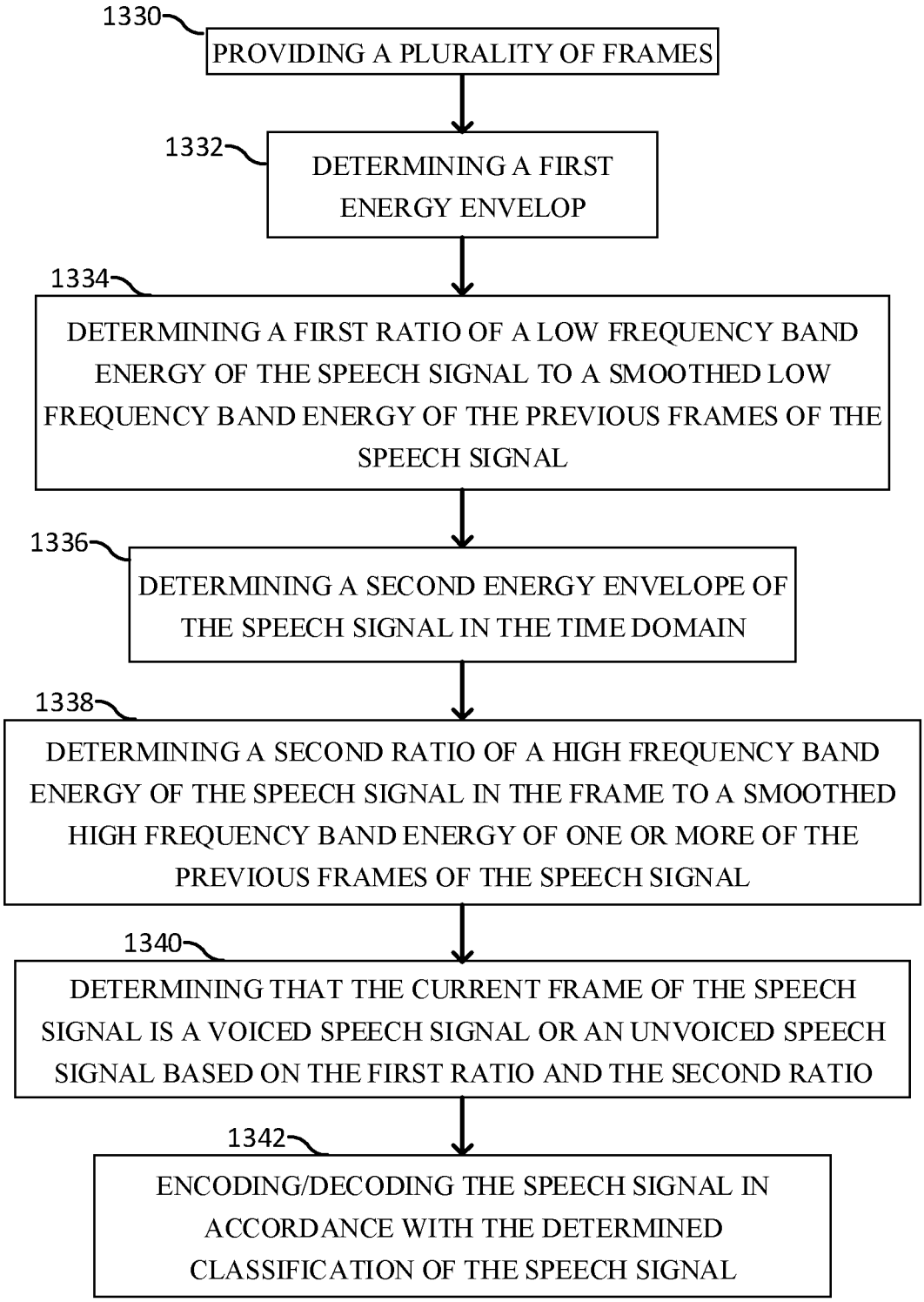

FIGS. 13A-13C are schematic illustrations of speech processing using various embodiments of speech processing described above.

Referring to FIG. 13A, a method for speech processing includes receiving a plurality of frames of a speech signal to be processed (box 1310). In various embodiments, the plurality of frames of a speech signal may be generated within the same audio device, e.g., comprising a microphone. In an alternative embodiment, the speech signal may be received at an audio device as an example. For example, the speech signal may be subsequently encoded or decoded. For each frame, an unvoicing/voicing parameter reflecting a characteristic of unvoiced/voicing speech in the current frame is determined (box 1312). In various embodiments, the unvoicing/voicing parameter may include a periodicity parameter, a spectral tilt parameter, or other variants. The method further includes determining a smoothed unvoicing parameter to include information of the unvoicing/voicing parameter in previous frames of the speech signal (box 1314). A difference between the unvoicing/voicing parameter and the smoothed unvoicing/voicing parameter is obtained (box 1316). Alternatively, a relative value (e.g., ratio) between the unvoicing/voicing parameter and the smoothed unvoicing/voicing parameter may be obtained. When deciding whether a current frame is better suited to be handled as an unvoiced/voiced speech, the unvoiced/voiced decision is made using the determined difference as a decision parameter (box 1318).

Referring to FIG. 13B, a method for speech processing includes receiving a plurality of frames of a speech signal (box 1320). The embodiment is described using a voicing parameter but equally applies to using an unvoicing parameter. A combined voicing parameter is determined for each frame (box 1322). In one or more embodiments, the combined voicing parameter may be a periodicity parameter and a tilt parameter and a smoothed combined voicing parameter. The smoothed combined voicing parameter may be obtained by smoothing the combined voicing parameter over one or more previous frames of the speech signal. The combined voicing parameter is compared with the smoothed combined voicing parameter (box 1324). The current frame is classified as a VOICED speech signal or an UNVOICED speech signal using the comparison in the decision making (box 1326). The speech signal may be processed, for example, encoded or decoded, in accordance with the determined classification of the speech signal (box 1328).

Referring next to FIG. 13C, in another example embodiment, a method for speech processing comprises receiving a plurality of frames of a speech signal (box 1330). A first energy envelope of the speech signal in the time domain is determined (box 1332). The first energy envelope may be determined within a first frequency band, for example, a low frequency band such as up to 4000 Hz. A smoothed low frequency band energy may be determined from the first energy envelope using the previous frames. A difference or a first ratio of the low frequency band energy of the speech signal to the smoothed low frequency band energy is computed (box 1334). A second energy envelope of the speech signal is determined in the time domain (box 1336). The second energy envelope is determined within a second frequency band. The second frequency band is a different frequency band than the first frequency band. For example, the second frequency may be a high frequency band. In one example, the second frequency band may be between 4000 Hz and 8000 Hz. An smoothed high frequency band energy over one or more of the previous frames of the speech signal is computed. A difference or a second ratio is determined using the second energy envelope for each frame (box 1338). The second ratio may be computed as the ratio between the high frequency band energy of the speech signal in the current frame to the smoothed high frequency band energy. The current frame is classified as a VOICED speech signal or an UNVOICED speech signal using the first ratio and the second ratio in the decision making (box 1340). The classified speech signal is processed, e.g., encoded, decoded, and others, in accordance with the determined classification of the speech signal (box 1342).

In one or more embodiments, the speech signal may be encoded/decoded using noise-like excitation when the speech signal is determined to be an UNVOICED speech signal, and wherein the speech signal is encoded/decoded with pulse-like excitation when the speech signal is determined to be as a VOICED signal.

In further embodiments, the speech signal may be encoded/decoded in the frequency-domain when the speech signal is determined to be an UNVOICED signal, and wherein the speech signal is encoded/decoded in the time-domain when the speech signal is determined to be as a VOICED signal.

Accordingly, embodiments of the present invention may be used to improve Unvoiced/Voiced decision for speech coding, bandwidth extension, and/or speech enhancement.

Figure 14:
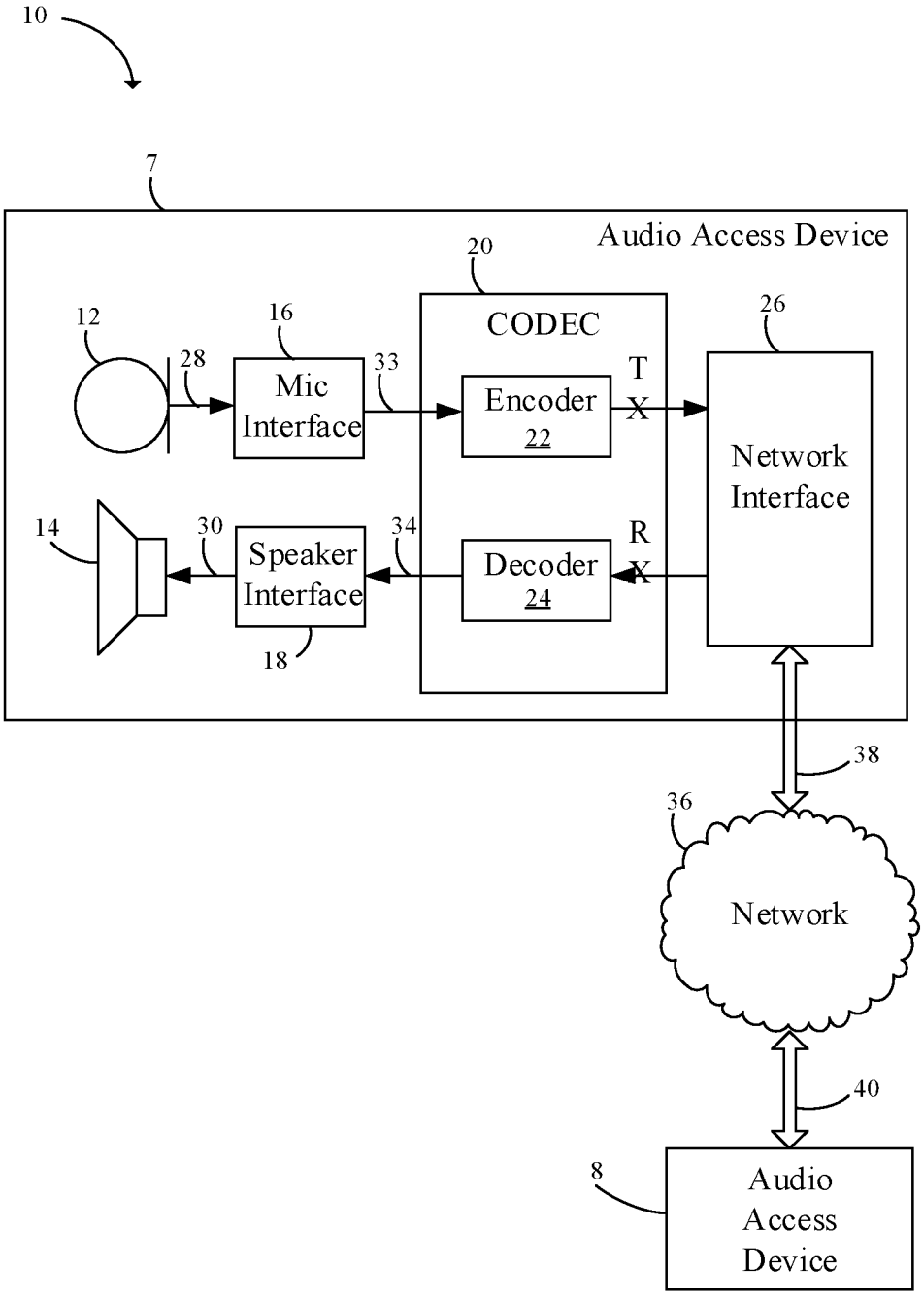
FIG. 14 illustrates a communication system 10 according to an embodiment of the present invention.

FIG. 14 illustrates a communication system 10 according to an embodiment of the present invention.

Communication system 10 has audio access devices 7 and 8 coupled to a network 36 via communication links 38 and 40. In one embodiment, audio access device 7 and 8 are voice over internet protocol (VOIP) devices and network 36 is a wide area network (WAN), public switched telephone network (PTSN) and/or the internet. In another embodiment, communication links 38 and 40 are wireline and/or wireless broadband connections. In an alternative embodiment, audio access devices 7 and 8 are cellular or mobile telephones, links 38 and 40 are wireless mobile telephone channels and network 36 represents a mobile telephone network.

The audio access device 7 uses a microphone 12 to convert sound, such as music or a person's voice into an analog audio input signal 28. A microphone interface 16 converts the analog audio input signal 28 into a digital audio signal 33 for input into an encoder 22 of a CODEC 20. The encoder 22 produces encoded audio signal TX for transmission to a network 26 via a network interface 26 according to embodiments of the present invention. A decoder 24 within the CODEC 20 receives encoded audio signal RX from the network 36 via network interface 26, and converts encoded audio signal RX into a digital audio signal 34. The speaker interface 18 converts the digital audio signal 34 into the audio signal 30 suitable for driving the loudspeaker 14.

In embodiments of the present invention, where audio access device 7 is a VOIP device, some or all of the components within audio access device 7 are implemented within a handset. In some embodiments, however, microphone 12 and loudspeaker 14 are separate units, and microphone interface 16, speaker interface 18, CODEC 20 and network interface 26 are implemented within a personal computer. CODEC 20 can be implemented in either software running on a computer or a dedicated processor, or by dedicated hardware, for example, on an application specific integrated circuit (ASIC). Microphone interface 16 is implemented by an analog-to-digital (A/D) converter, as well as other interface circuitry located within the handset and/or within the computer. Likewise, speaker interface 18 is implemented by a digital-to-analog converter and other interface circuitry located within the handset and/or within the computer. In further embodiments, audio access device 7 can be implemented and partitioned in other ways known in the art.

In embodiments of the present invention where audio access device 7 is a cellular or mobile telephone, the elements within audio access device 7 are implemented within a cellular handset. CODEC 20 is implemented by software running on a processor within the handset or by dedicated hardware. In further embodiments of the present invention, audio access device may be implemented in other devices such as peer-to-peer wireline and wireless digital communication systems, such as intercoms, and radio handsets. In applications such as consumer audio devices, audio access device may contain a CODEC with only encoder 22 or decoder 24, for example, in a digital microphone system or music playback device. In other embodiments of the present invention, CODEC 20 can be used without microphone 12 and speaker 14, for example, in cellular base stations that access the PTSN.

The speech processing for improving unvoiced/voiced classification described in various embodiments of the present invention may be implemented in the encoder 22 or the decoder 24, for example. The speech processing for improving unvoiced/voiced classification may be implemented in hardware or software in various embodiments. For example, the encoder 22 or the decoder 24 may be part of a digital signal processing (DSP) chip.

Figure 15:
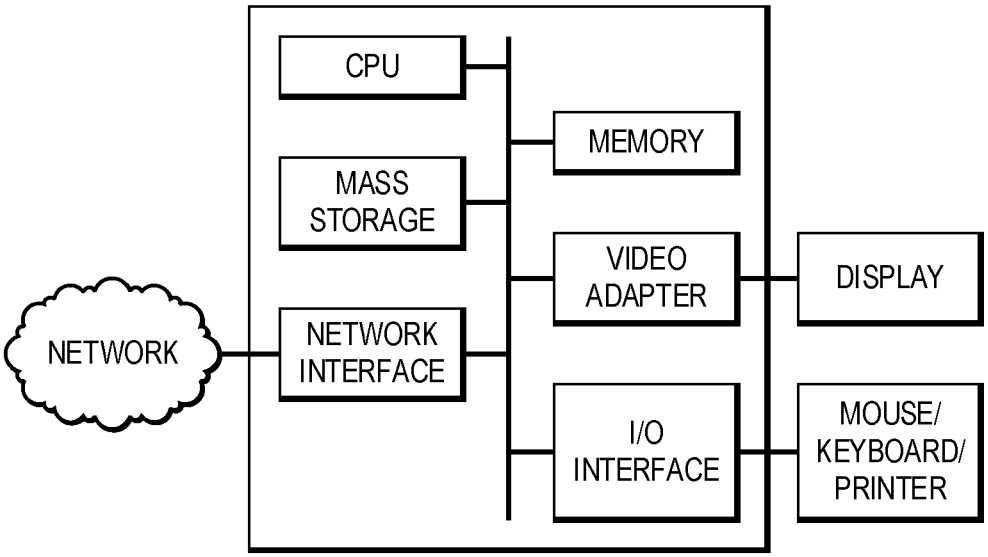
FIG. 15 illustrates a block diagram of a processing system that may be used for implementing the devices and methods disclosed herein.

FIG. 15 illustrates a block diagram of a processing system that may be used for implementing the devices and methods disclosed herein. Specific devices may utilize all of the components shown, or only a subset of the components, and levels of integration may vary from device to device. Furthermore, a device may contain multiple instances of a component, such as multiple processing units, processors, memories, transmitters, receivers, etc. The processing system may comprise a processing unit equipped with one or more input/output devices, such as a speaker, microphone, mouse, touchscreen, keypad, keyboard, printer, display, and the like. The processing unit may include a central processing unit (CPU), memory, a mass storage device, a video adapter, and an I/O interface connected to a bus.

The bus may be one or more of any type of several bus architectures including a memory bus or memory controller, a peripheral bus, video bus, or the like. The CPU may comprise any type of electronic data processor. The memory may comprise any type of system memory such as static random access memory (SRAM), dynamic random access memory (DRAM), synchronous DRAM (SDRAM), read-only memory (ROM), a combination thereof, or the like. In an embodiment, the memory may include ROM for use at boot-up, and DRAM for program and data storage for use while executing programs.

The mass storage device may comprise any type of storage device configured to store data, programs, and other information and to make the data, programs, and other information accessible via the bus. The mass storage device may comprise, for example, one or more of a solid state drive, hard disk drive, a magnetic disk drive, an optical disk drive, or the like.

The video adapter and the I/O interface provide interfaces to couple external input and output devices to the processing unit. As illustrated, examples of input and output devices include the display coupled to the video adapter and the mouse/keyboard/printer coupled to the I/O interface. Other devices may be coupled to the processing unit, and additional or fewer interface cards may be utilized. For example, a serial interface such as Universal Serial Bus (USB) (not shown) may be used to provide an interface for a printer.

The processing unit also includes one or more network interfaces, which may comprise wired links, such as an Ethernet cable or the like, and/or wireless links to access nodes or different networks. The network interface allows the processing unit to communicate with remote units via the networks. For example, the network interface may provide wireless communication via one or more transmitters/transmit antennas and one or more receivers/receive antennas. In an embodiment, the processing unit is coupled to a local-area network or a wide-area network for data processing and communications with remote devices, such as other processing units, the Internet, remote storage facilities, or the like.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. For example, various embodiments described above may be combined with each other.

Although the present invention and its advantages have been described in detail, it should be understood that various changes, substitutions and alterations can be made herein without departing from the spirit and scope of the invention as defined by the appended claims. For example, many of the features and functions discussed above can be implemented in software, hardware, or firmware, or a combination thereof. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for speech processing performed by an audio processing device, comprising:

receiving a plurality of frames of a speech signal;

determining, for a first frame of the speech signal, a first parameter for a first frequency band from a first energy envelope of the speech signal in a time domain, and a second parameter for a second frequency band from a second energy envelope of the speech signal in the time domain;

determining a smoothed first parameter and a smoothed second parameter based on information of a second frame that is prior to the first frame of the speech signal;

comparing the first parameter with the smoothed first parameter;

comparing the second parameter with the smoothed second parameter;

generating, based on the comparing the first parameter with the smoothed first parameter and the comparing the second parameter with the smoothed second parameter, a decision point to determine whether the first frame comprises unvoiced speech or voiced speech;

processing the first frame of the speech signal based on the decision point;

obtaining a synthesized speech signal based on the processed first frame; and outputting the synthesized speech signal.

2. The method of claim 1, wherein frequency of the second frequency band is higher than frequency of the first frequency band.

3. A method for speech processing performed by an audio processing device, comprising:

receiving a plurality of frames of a speech signal, wherein the plurality of frames comprise a first frame and a second frame prior to the first frame;

determining a first parameter for the first frame based on a product of (1- $P_{voicing}$) and (1-$P_{tilt}$), wherein $P_{voicing}$ is a periodicity parameter and $P_{tilt}$ is a spectral tilt parameter;

smoothing the first parameter for the first frame, based on a smoothed second parameter for the second frame, to obtain a smoothed first parameter for the first frame;

computing a difference between the first parameter for the first frame and the smoothed first parameter for the first frame;

determining a classification of the first frame based on the computed difference, the classification indicating whether the first frame is an unvoiced speech signal or not an unvoiced speech signal; and estimating energy of the first frame based on the classification of the first frame, wherein the estimated energy of the first frame when the classification indicates the first frame is an unvoiced speech signal is different from the estimated energy of the first frame when the classification indicates the first frame is not an unvoiced speech signal;

processing the first frame of the speech signal based on the estimated energy of the first frame;

obtaining a synthesized speech signal based on the processed first frame; and outputting the synthesized speech signal.

4. The method of claim 3, wherein the estimated energy of the first frame when the first frame is an unvoiced speech signal is higher than the estimated energy of the first frame when the first frame is not an unvoiced speech signal.

5. The method of claim 3, wherein when the computed difference is greater than a first threshold, the first frame is classified as an unvoiced speech signal, wherein when the computed difference is less than a second threshold, the first frame is classified as not an unvoiced speech signal, wherein the second threshold is less than the first threshold, and wherein when the computed difference is not less than the second threshold and not greater than the first threshold, the classification of the first frame is the same as the second frame.

6. The method of claim 3, wherein smoothing the first parameter for the first frame comprises weighting the first parameter for the first frame and the smoothed second parameter for the second frame.

7. The method of claim 6, wherein a weighting factor of the smoothed second parameter for the second frame is 0.9, and a weighting factor of the first parameter for the first frame is 0.1, when the smoothed second parameter for the second frame is greater than the first parameter for the first frame, and wherein the weighting factor of the smoothed second parameter for the second frame is 0.99, and the weighting factor of the first parameter for the first frame is 0.01, when the smoothed second parameter for the second frame is not greater than the first parameter for the first frame.

8. An audio access device, comprising:

a network interface; and a codec with an encoder or a decoder, wherein the codec is coupled to the network interface, wherein the network interface is configured to receive a plurality of frames of a speech signal, wherein the plurality of frames comprise a first frame and a second frame prior to the first frame, and wherein the encoder or decoder within the codec is configured to:

determine a first parameter for the first frame based on a product of (1- $P_{voicing}$) and (1-$P_{tilt}$), wherein $P_{voicing}$ is a periodicity parameter and $P_{tilt}$is a spectral tilt parameter;

smooth the first parameter for the first frame based on a smoothed second parameter for the second frame, to obtain a smoothed first parameter for the first frame;

compute a difference between the first parameter for the first frame and the smoothed first parameter for the first frame;

determine a classification of the first frame based on the computed difference, the classification indicating whether the first frame is an unvoiced speech signal or not an unvoiced speech signal;

estimate energy of the first frame based on the classification of the first frame, wherein the estimated energy of the first frame when the classification indicates the first frame is an unvoiced speech signal is different from the estimated energy of the first frame when the classification indicates the first frame is not an unvoiced speech signal; and process the first frame of the speech signal based on the estimated energy of the first frame, wherein the decoder is further configured to obtained a synthesized speech signal based on processing of the plurality of frames, and the audio access device further comprises a loudspeaker for outputting the synthesized speech signal.

9. The audio access device of claim 8, wherein the encoder or the decoder comprises a digital signal processor.

10. The audio access device of claim 8, wherein the estimated energy of the first frame when the first frame is an unvoiced speech signal is higher than the estimated energy of the first frame when the first frame is not an unvoiced speech signal.

11. The audio access device of claim 8, wherein when the computed difference is greater than a first threshold, the first frame is classified as an unvoiced speech signal, wherein when the computed difference is less than a second threshold, the first frame is classified as not an unvoiced speech signal, wherein the second threshold is less than the first threshold, and wherein when the computed difference is not less than the second threshold and not greater than the first threshold, the classification of the first frame is the same as the second frame.

12. The audio access device of claim 8, wherein the smoothed first parameter for the first frame is a weighted sum of the first parameter for the first frame and the smoothed second parameter for the second frame.

13. The audio access device of claim 12, wherein a weighting factor of the smoothed second parameter for the second frame is 0.9, and a weighting factor of the first parameter for the first frame is 0.1, when the smoothed second parameter for the second frame is greater than the first parameter for the first frame, and wherein the weighting factor of the smoothed second parameter for the second frame is 0.99, and the weighting factor of the first parameter for the first frame is 0.01, when the smoothed second parameter for the second frame is not greater than the first parameter for the first frame.

14. A speech processing apparatus, comprising:

a processor; and a memory storing computer instructions, that when executed by the processor, cause the processor to:

determine a first parameter for a first frame of a speech signal based on a product of $(1-P_{voicing})$ and $(1-P_{tilt})$, wherein $P_{voicing}$ is a periodicity parameter and $P_{tilt}$ is a spectral tilt parameter;

smooth the first parameter for the first frame based on a smoothed second parameter for a second frame prior to the first frame, to obtain a smoothed first parameter for the first frame;

compute a difference between the first parameter for the first frame and the smoothed first parameter for the first frame;

determine a classification of the first frame based on the computed difference, the classification indicating whether the first frame is an unvoiced speech signal or not an unvoiced speech signal;

estimate energy of the first frame based on the classification of the first frame, wherein the estimated energy of the first frame when the classification indicates the first frame is an unvoiced speech signal is different from the estimated energy of the first frame when the classification indicates the first frame is not an unvoiced speech signal;

process the first frame of the speech signal based on the estimated energy of the first frame;

obtain a synthesized speech signal based on the processed first frame; and output the synthesized speech signal.

15. The apparatus of claim 14, wherein the estimated energy of the first frame when the first frame is an unvoiced speech signal is higher than the estimated energy of the first frame when the first frame is not an unvoiced speech signal.

16. The apparatus of claim 14, wherein when the computed difference is greater than a first threshold, the first frame is classified as an unvoiced speech signal, wherein when the computed difference is less than a second threshold, the first frame is classified as not an unvoiced speech signal, wherein the second threshold is less than the first threshold, and wherein when the computed difference is not less than the second threshold and not greater than the first threshold, the classification of the first frame is the same as the second frame.

17. The apparatus of claim 14, wherein the smoothed first parameter for the first frame is a weighted sum of the first parameter for the first frame and the smoothed second parameter for the second frame.

18. The apparatus of claim 17, wherein a weighting factor of the smoothed second parameter for the second frame is 0.9, and a weighting factor of the first parameter for the first frame is 0.1 when the smoothed second parameter for the second frame is greater than the first parameter for the first frame, and wherein the weighting factor of the smoothed second parameter for the second frame is 0.99, and the weighting factor of the first parameter for the first frame is 0.01 when the smoothed second parameter for the second frame is not greater than the first parameter for the first frame.

* * * * *